US006477342B2

(12) United States Patent
Komiya et al.

(10) Patent No.: US 6,477,342 B2
(45) Date of Patent: Nov. 5, 2002

(54) IMAGE FORMING APPARATUS WITH CONDUCTIVE MEMBER ADJOINING LIGHT IRRADIATING PORTION

(75) Inventors: Yoshiyuki Komiya, Mishima (JP); Atsushi Takeda, Mishima (JP); Fumiteru Gomi, Shizuoka-ken (JP); Kouichi Hashimoto, Numazu (JP); Kenichi Shibuya, Shizuoka-ken (JP); Shuichi Kadota, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,106

(22) Filed: Mar. 12, 2001

(65) Prior Publication Data

US 2001/0051058 A1 Dec. 13, 2001

(30) Foreign Application Priority Data

| | | |
|---|---|---|
| Mar. 13, 2000 | (JP) | 2000-068514 |
| Mar. 30, 2000 | (JP) | 2000-094027 |
| Apr. 6, 2000 | (JP) | 2000-104599 |
| May 31, 2000 | (JP) | 2000-162214 |

(51) Int. Cl.[7] ..... G03G 15/00; G03G 15/01; G03G 21/00

(52) U.S. Cl. ..... 399/98; 399/99; 347/138

(58) Field of Search ..... 399/98, 99; 347/138, 347/257, 137

(56) References Cited

U.S. PATENT DOCUMENTS

| | | | | |
|---|---|---|---|---|
| 4,843,425 A | * | 6/1989 | Itaya et al. | 399/98 |
| 5,276,481 A | * | 1/1994 | Kinoshita et al. | 399/29 |
| 5,486,905 A | | 1/1996 | Takeda et al. | 355/215 |
| 5,613,174 A | * | 3/1997 | Denton et al. | 399/98 |
| 5,790,920 A | * | 8/1998 | Teramura et al. | 399/99 X |
| 6,144,820 A | | 11/2000 | Ishii et al. | 399/90 |
| 6,215,967 B1 | | 4/2001 | Takeda et al. | 399/43 |
| 6,219,509 B1 | | 4/2001 | Komiya et al. | 399/168 |

* cited by examiner

*Primary Examiner*—Joan Pendegrass
(74) *Attorney, Agent, or Firm*—Fitzpatrick, Cella, Harper & Scinto

(57) ABSTRACT

Toner particles fly off from a photosensitive drum to an exposure light emitting portion by a change of electric potential distribution on the photosensitive drum caused by image exposure in a following process. This causes a poor copy of an image by adhering the toner particles to the exposure light emitting portion. This phenomena affects a tandem type of copiers with multi-stations including photosensitive drums and exposure light emitting positions. An apparatus capable of suppressing toner adhesion to an exposure is provided to solve the above problem.

27 Claims, 30 Drawing Sheets

| CIRCUMSTANCE | ABSOLUTE AMOUNT OF MOISTURE h | SET VALUE OF BIAS VOLTAGE |
|---|---|---|
| 1 | h≦1.0g | −3000v |
| 2 | 1.0g<h≦2.9g | −2200v |
| 3 | 2.9g<h≦5.8g | −1800v |
| 4 | 5.8g<h≦10.5g | −1500v |
| 5 | 10.5g<h≦15.0g | −1500v |
| 6 | 15.0g<h≦21.6g | −1500v |
| 7 | 21.6g<h | −1500v |

IMAGE FORMING APPARATUS WITH CONDUCTIVE MEMBER ADJOINING LIGHT IRRADIATING PORTION

BACKGROUND OF THE INVENTION

1. Field of the Invention

The present invention relates to an image forming apparatus for developing with a developer and recording an electrostatic image on an image bearing body corresponding to an image to be recorded, on a recording material such as paper.

2. Related Background Art

Conventional types of many image forming apparatuses using an electrophotography method or an electrostatic recording method have been proposed. A schematic structure and the operation of such apparatuses are explained using FIG. 9.

When a copy start signal is input to the image forming apparatus shown in FIG. 9, a photosensitive drum 1 is charged as an image bearing body to be a predetermined potential by a charging apparatus 3.

On the other hand, a unit 9 having a subject irradiation lamp, a short focus lens array, and a CCD sensor is scanned with respect to a original G mounted on a copy board 10 while irradiating the original, and light reflected by the surface of the original from the irradiated scanning light is imaged by the short focus lens array and made incident to the CCD sensor. The CCD sensor is structured by a light receiving portion, a transferring portion, and an output portion.

Optical signals are changed into electric charge signal in the light receiving portion, are transferred in order to the output portion in synchronous with a clock pulse in the transferring portion, and the electric charge signals are converted into electric voltage signals, amplified, and made low impedance in the output portion. The obtained analog signals are transformed into digital signals by performing a known imaging process, and are then sent to a printer portion. In the printer portion, an electrostatic latent image corresponding to the subject image is formed on the photosensitive drum 1 by scanning on-off luminary of solid state laser element triggered by the received image signal in laser exposing means 2 rotational multi-faced mirror rotating at high speed.

Next, the electrostatic latent image is developed by a developer apparatus 4 holding a two-component developer having toner particles and carrier particles and obtained on the photosensitive drum 1 as a toner image.

The toner image thus formed on the photosensitive drum 1 is electrostatically transferred onto a transfer material by a transfer apparatus 7. The transfer material is then electrostatically separated, and conveyed to a fixing apparatus 6, thermally fixed, and the image is output. The transfer apparatus 7 comprises a transfer belt 71 wrapped around a pair of rollers 72 and 73, and a transfer electrostatic blade 74 arranged on the inside of the transfer belt 71.

Recently, due to advantages such as low ozone and low electric power, a contact charging apparatus, namely an apparatus for performing charging of an object by contacting a charged member, to which a voltage is applied, to the object, has been made practical as the charging member of the photosensitive drum 1.

It is preferable to use a magnetic brush apparatus as this type of charging member because of stable charging contact.

In the magnetic brush contacting charging apparatus, changing begins by contacting conductive magnetic particles directly constrained on a magnet, or magnetically constrained on a sleeve enclosing a magnet, to a charging body to be charged while stopped or while rotating and by applying a voltage.

Further, a brush on which conductive fibers are formed (hereafter referred to as a fur brush) and a conductive rubber roller in which a conductive rubber is made into a roll shape are also preferably used as a contact charging member.

In particular, if a photosensitive body such as a normal organic photosensitive body having a surface layer on which conductive micro-particles are scattered, or an amorphous photosensitive body is used as the charging body to be charged while using this type of contact charging member, then it is possible to obtain a static charge potential on the surface of the charging body to be charged which is nearly equivalent to the direct current component of the bias applied to the contact charging member. This type of charging method focused on recently is referred to as injection charging. The injection charging of the body to be charged is performed without utilizing electric discharge developing using a corona charging apparatus, and therefore perfectly, ozone-less and low power consumption charging becomes possible provided that injection charging is used. Furthermore, in recent years, color electrophotography apparatus themselves have photosensitive bodies and developer apparatuses corresponding to each of four colors as with an image forming apparatus shown in FIG. 1 as an embodiment of the present invention, and tandem methods in which four color images are overlapped in order on a transfer material during one pass, namely during conveying the transfer material one time have been developed. This method has an advantage in that color recording may be conducted at high speed.

In addition, a cleaner-less method is employed in the tandem method color image forming apparatus having the magnetic brush charging apparatus shown in FIG. 1, in which cleaning of the remaining transfer toner on the photosensitive drum is performed by the developer apparatus 4 at the same time as developing of the electrostatic latent image, without providing a specialized cleaning apparatus.

With an image forming apparatus prepared with the above cleaner-less method, the toner remaining on the photosensitive body which was not transferred to the transferring material is collected temporarily by the magnetic brush charging apparatus 3, and is next discharged once again to the photosensitive drum after being polarized, and is collected by the developer apparatus. However, the toner flies off from the photosensitive drum to an exposure light emitting portion by a changes of electric potential distribution on the photosensitive drum caused by image exposing in the next process. A problem therefore exists in which poor copy of an image is caused by the toner thus adhering to the exposure apparatus.

In particular, in case of a tandem type method in which four stations are arranged in parallel and imaging processes are performed by each station independently, there is a problem in which a colour of station toner is mixed into a colour of toner expelled from the magnetic brush charging apparatus.

SUMMARY OF THE INVENTION

The present invention is made in view of the above stated issues, and an object of the present invention is to provide an image forming apparatus capable of suppressing toner adhesion to an exposure surface.

Another object of the present invention is to provide an image forming apparatus, comprising: a photosensitive member; image exposing means for exposing the photosensitive member in accordance with an image information, said image exposing means having a lens facing the photosensitive member; a conductive member adjacent to the lens; and voltage application means for applying a voltage to the conductive member, wherein a voltage equal to or greater than 1500 V as applied by the voltage application means.

In addition, another object of the present invention is to provide an image forming apparatus comprising: a photosensitive member; charging means for charging the photosensitive member; image exposing means for exposing the photosensitive member in accordance with an image information, said image exposing means having a lens facing the photosensitive member; a conductive member adjoining the lens; and voltage application means for applying a voltage to the conductive member; wherein the voltage application means applies a voltage to the conductive member in synchronous with a timing for voltage application to the charging means.

Additionally, another object of the present invention is to provide an image forming apparatus, comprising: a photosensitive member; image exposing means for exposing the photosensitive member in accordance with an image information, said image exposing means having a lens facing the photosensitive member; a conductive member adjoining the lens; and voltage application means for applying a voltage to the conductive member; wherein the voltage application means applies a voltage to the conductive member in synchronous a timing for driving the photosensitive member.

Another object of the present invention is to provide an image forming apparatus, comprising: a photosensitive member; image exposing means for exposing the photosensitive member in accordance with an image information, said image exposing means having a lens facing the photosensitive member; a conductive member adjoining the lens; environment detection means for detecting an environmental state; and voltage application means for applying a voltage to the conductive member; wherein the voltage application means applies a voltage to the conductive member in correspondence with output of the environmental detection means.

In addition, another object of the present invention is to provide an image forming apparatus, comprising: a photosensitive member; charging means for charging the photosensitive member; image exposing means for exposing the photosensitive member in accordance with an image information, said image exposing means having a lens facing the photosensitive member; a conductive member adjoining the lens; wherein both and portions of the conductive member in a longitudinal direction are outside of a charging region.

Additional objectives of the present invention will become evident by reading the detailed descriptions below while referring to the attached drawings.

BRIEF DESCRIPTION OF THE DRAWINGS

FIG. 29A is a diagram showing a positional relationship between a conductive member and an exposure light irradiation region and the conductive member; and FIG. 29B is a diagram showing a positional relationship between the conductive member, the exposure light irradiation region, and a magnetic particle coated region;

DESCRIPTION OF THE PREFERRED EMBODIMENTS

<Embodiment 1>

Figure 1:
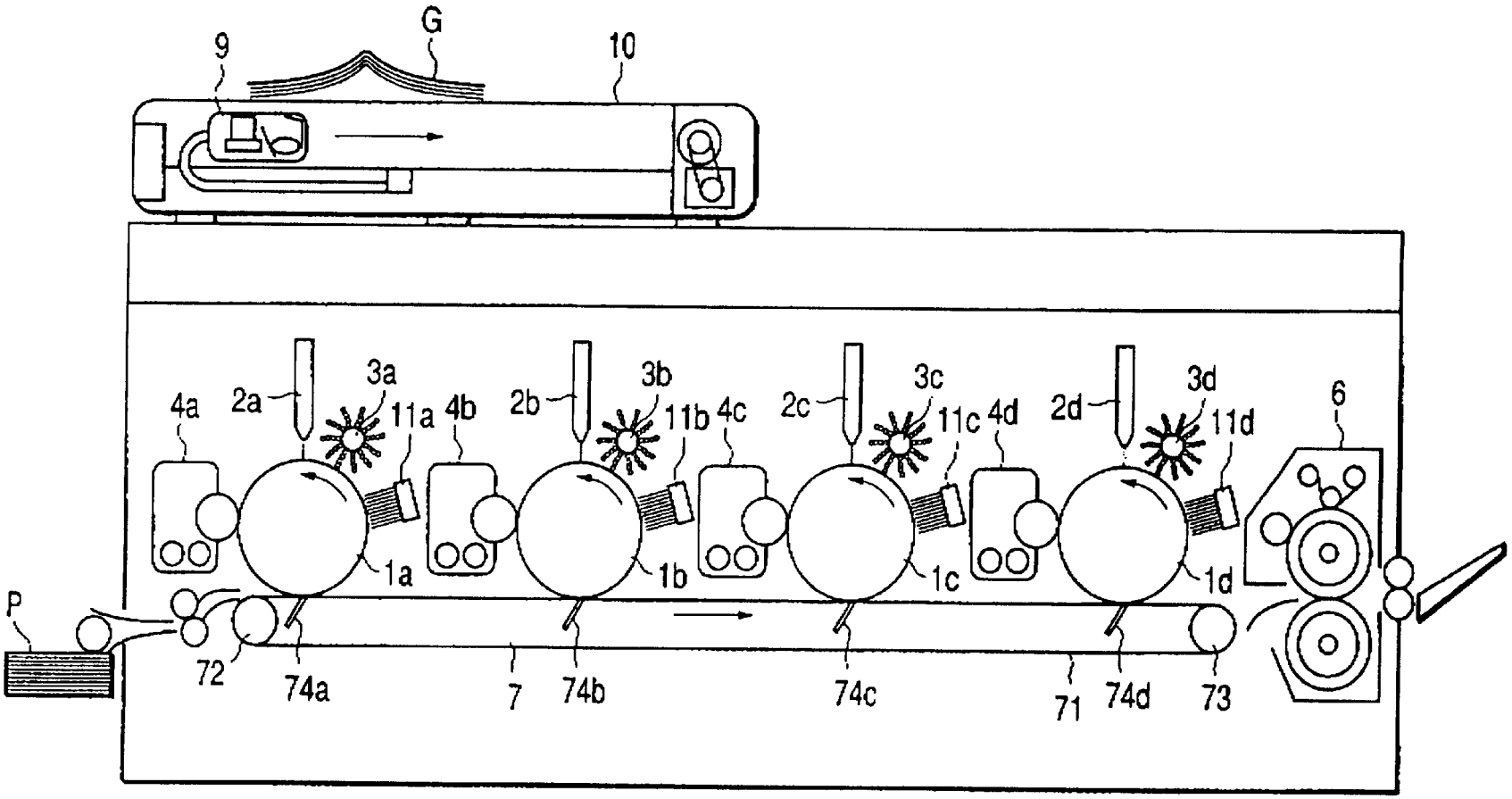
FIG. 1 is a cross sectional diagram of an image forming apparatus showing a first embodiment of the present invention.

FIG. 1 shows a first embodiment of the present invention.

An image forming apparatus shown in FIG. 1 has a structure in which a leader portion 9 is placed on a printer portion. The leader portion 9 has a structural similar to that shown in FIG. 8, and therefore an explanation to the leader portion is omitted.

In FIG. 1, the printer portion of the image forming apparatus has a structure in which the first to fourth image forming portions, capable of forming visible images corresponding to Y, M, C, and K, for example, are tandem arranged within the image forming apparatus. The image forming portions are prepared with photosensitive drums 1*a*, 1*b*, 1*c*, and 1*d*, respectively. Exposing apparatuses 2*a*, 2*b*, 2*c*, and 2*d*; magnetic brush charging apparatuses 3*a*, 3*b*, 3*c*, and 3*d*; transferring apparatuses 7*a*, 7*b*, 7*c*, and 7*d*; developing apparatuses 4*a*, 4*b*, 4*c*, and 4*d*; and conductive brushes 11*a*, 11*b*, 11*c*, and 11*d* or the like are arranged in the periphery of the photosensitive drums 1*a* to 1*d*, respectively.

The exposing apparatus 2*a* to 2*d* as an exposing means, which are latent image forming means, use LED array writer heads here.

Figure 2:
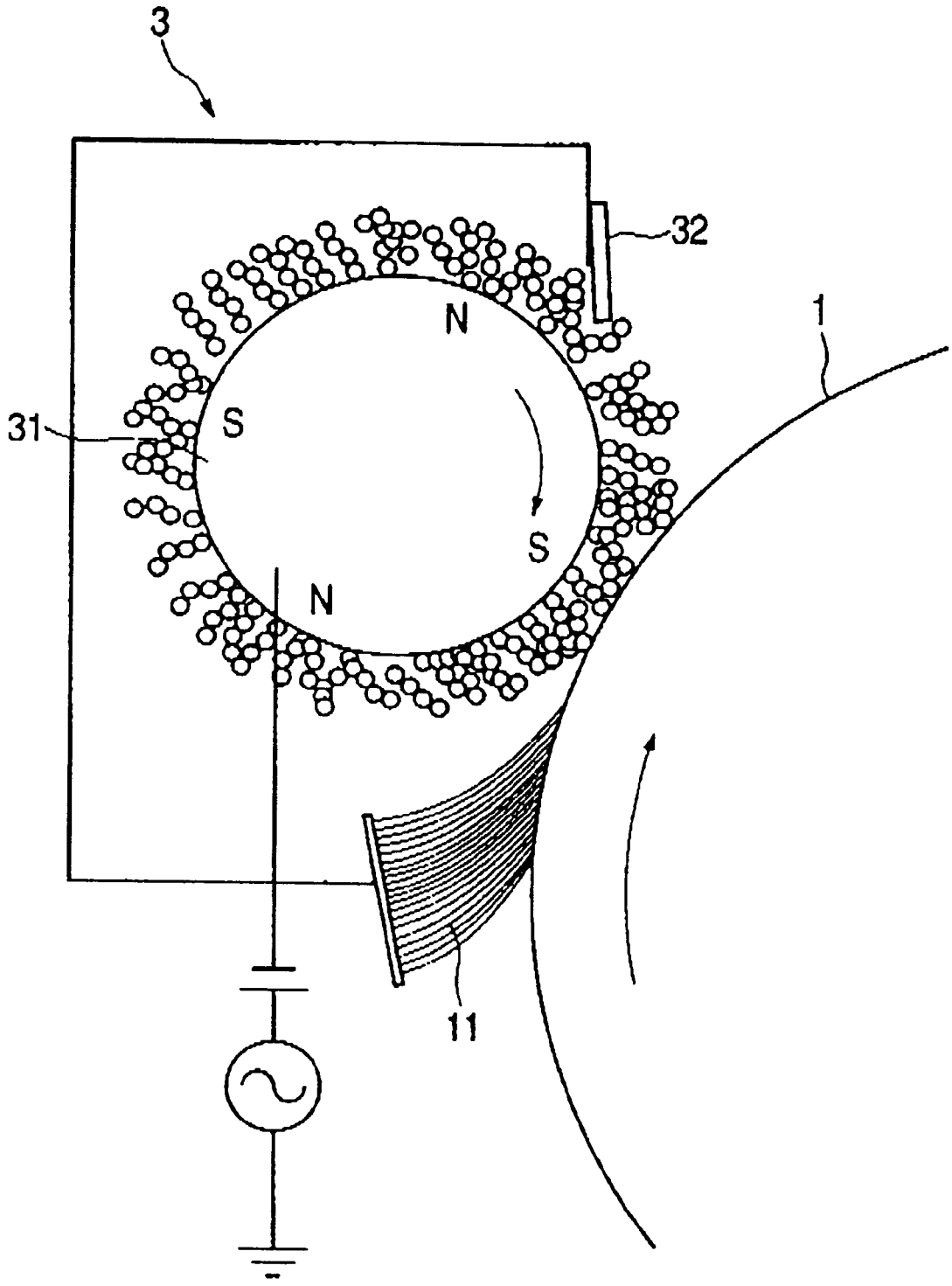
FIG. 2 is a cross sectional diagram of a magnetic brush charging apparatus of FIG. 1.

FIG. 2 shows a schematic diagram of a magnetic brush charging apparatus 3 (3*a*, 3*b*, 3*c*, and 3*d*) as a charging means used by Embodiment 1. The charging means is the magnetic brush charging apparatus 3 which uses a magnetic carrier. It is preferable to use a magnetic carrier having an average particle diameter of 10 to 100 $\mu$m, a saturation magnetization of 20 to 250 emu/cm$^3$, and a resistance of $1\times10^2$ to $1\times10^{10}$ Ωcm as the charging magnetic carrier, and if insulation faults such as pin holes exist in the photosensitive drum, then it is preferable to use a magnetic carrier having a resistance equal to or greater than $1\times10^6$ Ωcm. It is good to use a magnetic carrier having as small a resistance as possible in order to have good charging performance, and therefore magnetic particles having an average diameter of 25 $\mu$m, a saturation magnetization of 200 emu/cm$^3$, and a resistivity of $5\times10^6$ Ωcm are used in Embodiment 1.

Further, a magnetic carrier in which resistance adjustment is performed by oxidation and reduction of a ferrite surface may also be used as the charging magnetic carrier used in Embodiment 1.

A photosensitive drum such as a normally used organic photosensitive body is used as the photosensitive drum 1 in Embodiment 1. However, if the photosensitive body possesses a surface area having a resistance of $10^2$ to $10^{14}$ Ωcm, or if an amorphous silicon photosensitive body is used, then charge injection charging can be achieved, ozone generation is stopped, and it is effective in reducing power consumption.

Further, it becomes possible to increase charging ability. As the photosensitive drum 1 in Embodiment 1, a negative charging organic photosensitive material is formed into the five layers stated below, from a first layer to a fifth layer, on aluminum drum body having a diameter of 30 mm is used.

The first layer is a base layer, and is a conducting layer having a thickness of 20 $\mu$m formed in order to average out defects and the like in the aluminum body.

The second layer is a layer to stop hole injection. The second layer fulfills a role of preventing reduction of a negative electric charge on the charged surface of the photosensitive body by positive electric charge injected from the aluminum body. The second layer is a mid resistance layer having a thickness of 1 $\mu$m in which the resistance is regulated to be on the order of $1\times10^6$ Ωcm by amylan resin and methoxymethyl nylon.

The third layer is a charge generating layer, and is an approximately 0.3 $\mu$m thick layer on which a disazo pigment is distributed in a resin. A positive negative electric charge pair is generated by being exposed to light.

The fourth layer which is a p-type semiconductor is a charge transporting layer, and is a polycarbonite resin in which hydrozone is distributed. Therefore, negative electric charge on the charged surface of the photosensitive body cannot move through this layer, and only positive electric charges generated by the electric charge generating layer can be transported to the surface of the photosensitive body.

The fifth layer is a charge injecting layer, and is a coated layer of a material in which super fine $SnO_2$ particles are distributed in an insulating resin binder. Specifically, $SnO_2$ particles having a diameter of approximately 0.03 $\mu$m are doped with antimony, an insulating filter having light transmitting characteristics, and made low resistance (made conductive), and the $SnO_2$ particles are distributed into an insulating resin at 70% by weight, as the coated layer material.

This mixed coating solution is then applied with a thickness of approximately 3 $\mu$m using a suitable process such as dipping, spraying, rolling, or beam application, forming the electric charge injecting layer. The surface resistance is $10^{13}$ Ωcm. The direct charging ability is increased by thus controlling the surface resistance, and a high quality image can be obtained. The photosensitive body is not limited to organic photo conductor (OPC), and can also be realized by an amorphous silicon (a-Si) drum, and in addition, high endurance can be achieved.

The volume resistivity of the surface layers is a value measured by forming a 200 $\mu$m gap between metallic electrodes, injecting the surface layer mixed solution between the electrodes and forming a film, and then applying a 100 V voltage between the electrodes. The measurements are values found at conditions of a temperature of 23° C. and a relative humidity of 50%.

A development process is explained next.

In general, methods of developing are roughly divided into four types. A method of developing in which a non-magnetic toner is coated onto a sleeve such as a blade, and a magnetic toner is coated in accordance with a magnetic force, and transported. This is a development method in which there is a state of non-contact with respect to the photosensitive drum (single component non-contact development). In a second method, toner coated as stated above is exposed in a state of contact with respect to the photosensitive drum (single component contact development). In a third method of developing, a magnetic carrier is mixed with toner particles as a developer, and transported in accordance with a magnetic force and developed in a state of contact with the photosensitive drum (two-component contact development). Finally, a method of developing in which the above two-component developer is in a state of non-contact with the photosensitive drum is a fourth method (two-component non-contact developing). The two-component contact developing method is often used from the standpoint of high image quality and high stability.

Figure 3:
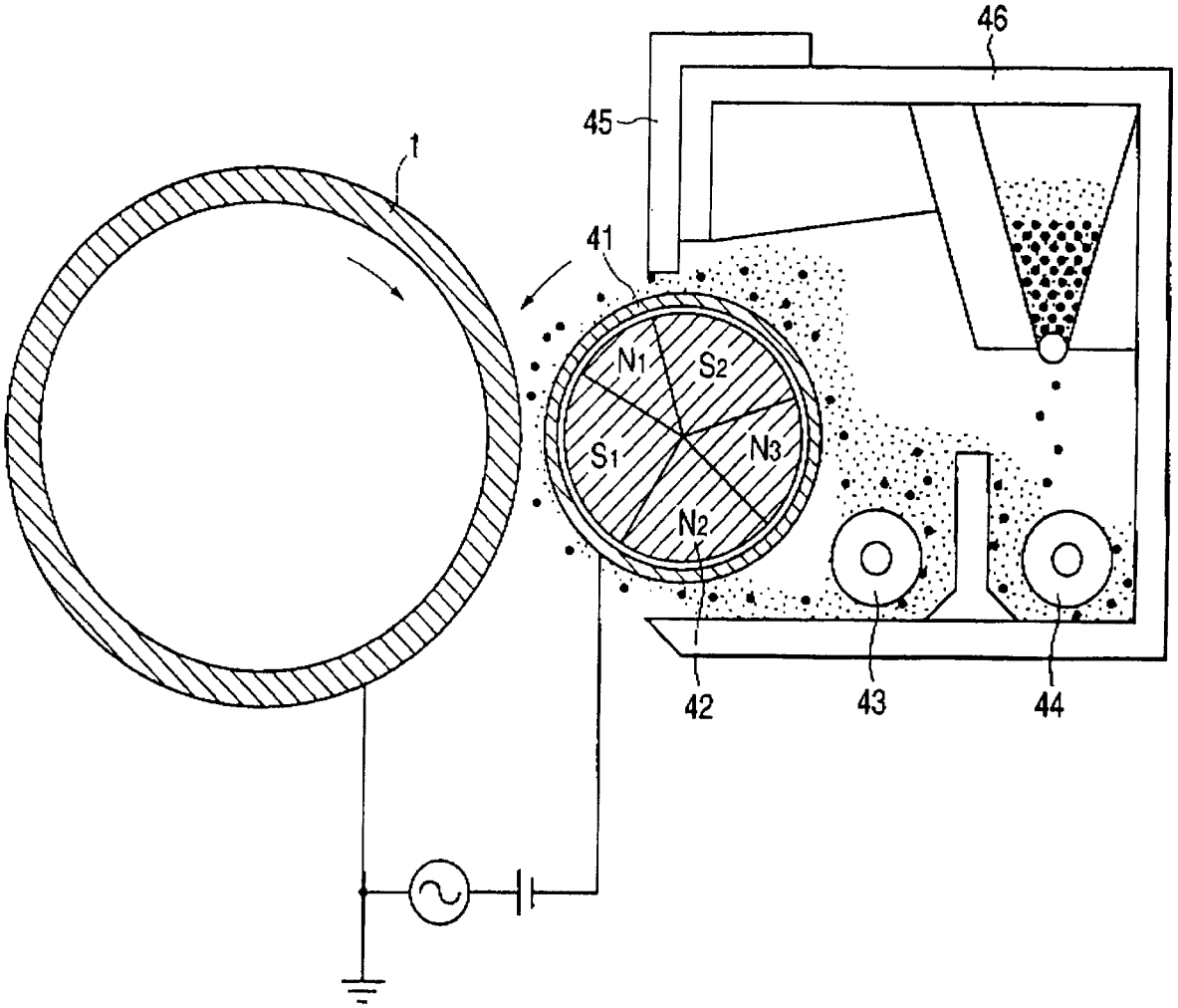
FIG. 3 is a cross sectional diagram showing a two-component developer apparatus of FIG. 1.

FIG. 3 is a schematic diagram of a developer apparatus 4 used in Embodiment 1 and which uses two-component magnetic brush developing.

Shown in FIG. 3, reference numeral 41 denotes a developer sleeve, reference numeral 42 denotes a magnet roller fixed and arranged within the developer sleeve 41, reference numerals 43 and 44 denote agitator screws, 45 denotes a regulating blade arranged in order to form a thin film of a developer on the surface of the developer sleeve 41, and reference numeral 46 denotes a developer container. The developer sleeve 41 is arranged such that the nearest contact region becomes 500 $\mu$m with respect to the photosensitive drum 1 at least during the time of development, and is set such that development can be performed in a state in which the developer is in contact with the photosensitive drum 1.

The two-component developer used in Embodiment 2 is one in which 1% by weight of titanium oxide particles having an average diameter of 20 nm are added around negatively charged toner particles having an average diameter of 6 $\mu$m. A magnetic carrier with an average particle diameter of 35 $\mu$m and having a saturation magnetization of 205 emu/cm$^3$ is used as the developer magnetic carrier.

Further, a mixture of the toner and the developer magnetic carrier at a weight ratio of 6:94 is used as the developer. The toner within the developer at this time has a triboelectrifaction of approximately $25\times10^{-3}$ c/kg.

A development method in which an electrostatic latent image is made into an image in accordance with a two-component magnetic brush method using the developer apparatus 4, and circulation of the developer, are explained below.

First, developer drawn up by an N2 pole accompanying rotation of the developer sleeve 41 is regulated in accordance with the regulation blade 45 arranged in a direction perpendicular to the developer sleeve 41 in a process of being transported from an S2 pole to an N1 pole, and is formed into a thin layer on the developer sleeve 41. The developer formed into a thin layer here is formed into standing spikes in accordance with a magnetic force when transported to a main developer electrode S1 pole. The electrostatic latent image is developed by the developer formed into the spike shapes, and the developer on the developer sleeve 41 is then returned to which the developer container 46 by a repelling magnetic field of electrodes N3 and N2.

A direct current voltage and an alternating current voltage are applied to the developer sleeve 41 from an electric power supply not shown in the figure. In Embodiment 1, a voltage of −480 V is applied as the direct current voltage, and a voltage having Vpp=1500 V and Vf=3000 Hz is applied as the alternating current voltage.

In general, the developing efficiency increases if an alternating current voltage is applied in a two-component developing method, and the image becomes high quality, but on the other hand, a problem develops in which the image more easily becomes blurry. Normally, therefore, the image is prevented from becoming blurry in accordance with setting an electric potential difference between the direct current voltage applied to the developer apparatus 4 and the surface electric potential of the photosensitive drum 1. The electric potential difference for preventing blurriness is referred to as a blur removing electric potential Vback, and the toner is prevented from adhering to non-image regions during developing by this electric potential difference.

The toner image is next transferred to a recording material in accordance with the transfer apparatus 7. The transfer apparatus 7 has an endless belt 71 suspended between a drive roller 72 and a follower roller 73, and is rotated in the direction of the arrow in FIG. 2. In addition, in the transfer apparatus 7, a transfer charging blade 74 (transfer charging blades 74*a,* 74*b,* 74*c,* and 74*d*), end the transfer charging blade 74 generates a pressurizing force in a direction from the inside of the belt 71 to the photosensitive drums 1*a* to 1*d*. Toner images are transferred onto the surface of the recording material in order on the photosensitive drum 1 by performing charging of a polarity which is the reverse of the toner polarity from the back side of the recording material by using voltage supplied form a high voltage electric power supply not shown in the figure.

The recording material is conveyed from a paper supplying conveyor apparatus to a transfer portion in which the photosensitive drums 1*a* to 1*d* and the belt 71 are formed at a suitable timing in synchronous with the rotation of the photosensitive drums 1*a* to 1*d*.

Further, a polyimide resin belt having a thickness of 75 $\mu$m is used as the belt 71 in Embodiment 1. The belt 71 material is not limited to polyimide resin, and an appropriate material such as: a plastic such as polycarbonite resin, polyethylene terephthalate resin, polyfluoride vinylidine resin, polyethylene naphthalate resin, polyether ether ketone resin, polyether sulphone resin, and polyurethane resin; a fluoride; and a silicon rubber can be used.

The film thickness is also not limited to 75 $\mu$m, and a thickness from 25 to 2000 $\mu$m, preferably between 50 and 150 $\mu$m, can be used.

In addition, a material having a resistance of $1\times10^5$ to $1\times10^7$ Ω is used as the transfer charging blade 74. A +15 $\mu$A bias is applied to the transfer charging blade 74 in accordance with constant electric current control, and transfer is performed.

The toner images formed on each of the photosensitive drums 1*a* to 1*d* are thus electrostatically transferred to the recording material by each of the transfer charging blades 74*a* to 74*d*. The transfer material is then conveyed to a fixer apparatus 6, thermally fixed, and the image is output.

On the other hand, the toner which was not transferred remains on each of the photosensitive drums 1*a* to 1*d* after the transfer process.

The remaining transfer toner on each of the photosensitive drums 1*a* to 1*d* often has a mixture of positive and negative polarities due to separation discharges at the time of transfer. The remaining transfer toner having mixed polarities is conveyed to the magnetic brush charging apparatuses 3*a* to 3*d,* respectively, is mixed with the magnetic particles within the charging apparatuses, and charged such that the polarities are all negative, and then is expelled out to the photosensitive drums. At this point input of the toner to the charging apparatuses cannot be sufficiently performed by only applying a direct current voltage to the charging magnetic brushes, but the toner can be easily taken up by the charging apparatuses in accordance with an oscillation effect due to an electric field between the photosensitive drums and the charging apparatuses if an alternating current voltage is applied to the magnetic brush charging apparatuses 3*a* to 3*d*.

The remaining transfer toner which is expelled onto the photosensitive drums after having it polarities aligned by the charging apparatuses is then recovered within the developer apparatuses in accordance with the electric field for removing blurriness during developing. The recovery of the remaining transfer toner at the same time as developing is performed simultaneously with the image forming processes of charging, exposure, developing, and transfer for cases in which the image region in the direction of rotation of the photosensitive drum is longer than the circumference of the photosensitive drum 1. The remaining transfer toner is thus recovered and also used in subsequent processes, and therefore the toner is not wasted. Further, the advantages from the standpoint of space are also large, and it becomes possible to greatly reduce size.

Figure 4:
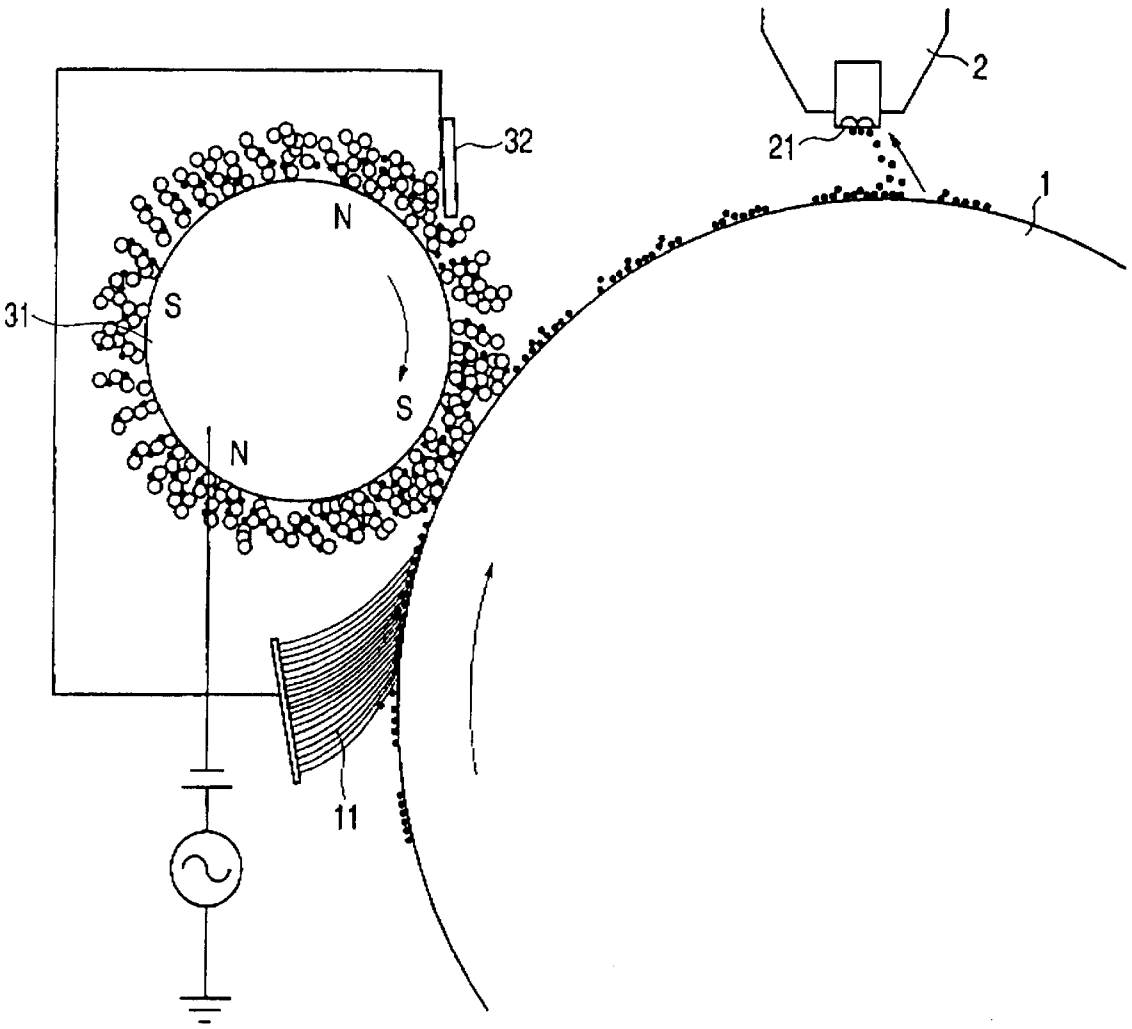
FIG. 4 is a schematic diagram of developing which the present invention aims to improve.

However, as shown in FIG. 4, a phenomenon develops in the image forming apparatus employing the cleaner-less method in which cleaning is performed at the same time as development utilizing the magnetic brush charging apparatus 3. With this phenomenon, the remaining toner expelled onto the photosensitive drum 1 after being recovered by the magnetic brush charging apparatus 3 flies off from the surface of the drum, is pulled in the direction of an exposure light irradiating portion 21, and adheres to exposure light irradiating portion 21 due to an electric field along with changes in the electric potential of the surface of the photosensitive drum when exposure is performed in accordance with the exposure apparatus in the next step. This phenomenon is hereafter referred to as an exposure scattering phenomenon.

The exposure scattering phenomenon is thought to develop by changes in the particle distribution on the surface of the sensitive drum due to receiving exposure light. The inventor of the present invention performed an experiment in which 4% toner is forcibly mixed into the magnetic brush charging apparatus 3 with the structure used in Embodiment 1, and then this toner is forcibly expelled to the photosensitive drum while performing exposure of light over the entire surface. The developer was not input to the developer apparatus 4 in this experiment, and driving of the developer 4 and bias current application were not performed. The electric potential of the surface of the photosensitive drum after charging (hereafter referred to as Vd) was set to −800 V, and by changing the electric potential of the surface of the photosensitive drum after exposure (hereafter referred to as V1), an experiment was performed in which the latent image contrast, the difference between Vd and V1, was changed. The experimental results made clear that the smaller the latent image contrast, the more that the toner expelled onto the photosensitive drum 1 flew off in a direction perpendicular to the direction of the exposure light irradiation portion 21. Thus for a case in which the latent image contrast under actual operating conditions is small, namely when half tone exposure is performed, the exposure scattering phenomenon develops conspicuously. The exposure light irradiating portion 21 is shielded by adhering toner when the exposure scattering phenomenon develops, and therefore an appropriate amount of exposure light cannot be imparted to the photosensitive drum by portions of the exposure light irradiation portion 21 to which the toner adheres. An image irregularity in which the image is lost develops.

Figure 5:
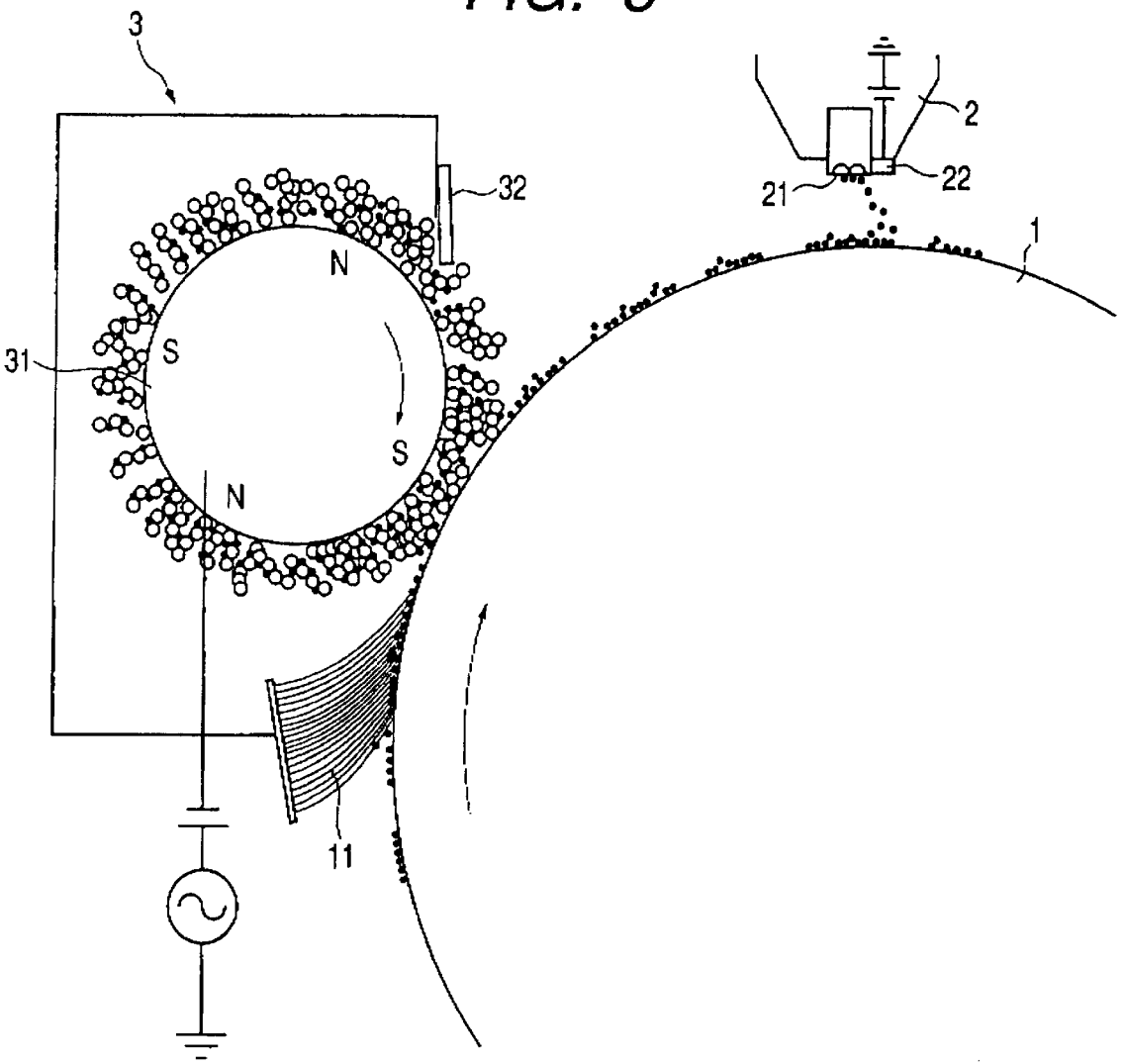
FIG. 5 is a structural diagram of the periphery of an exposure apparatus shown in FIG. 1.

In order to prevent this type of exposure scattering phenomenon, a structure is used in which a conductive member 22 is formed adjoining the exposure light irradiating portion 21 of the exposing apparatus 2, and downstream with respect to the direction of rotation of the photosensitive drum, in Embodiment 1, as shown in FIG. 5. A bias is applied to the conductive member 22.

The electric field from the surface of the photosensitive drum toward the direction of the exposure light irradiating portion 21 of the exposing apparatus 2 becomes weaker in accordance with the structure of Embodiment 1, and the electric field works on the toner expelled onto the photosensitive drum 1 in a direction pushing the toner in the direction of the photosensitive drum 1, and the development of the exposure scattering phenomenon can be prevented.

The inventor of the present invention performed endurance experiments on in which the electric potential of the surface of the drum charged with the magnetic brush charging apparatus 3*b* of the second station of the tandem method is approximately −500 V, −700 V, and −900 V, and the bias applied to the conductive member formed adjoining the exposure light irradiation portion of the exposure apparatus 2*b* is set to 0V, −500 V, −700 V, −900 V, −1200 V, and −1500 V. The experimental results obtained with regard to the effects on the exposure scattering for each of these cases are shown in FIG. 6.

Figure 6:
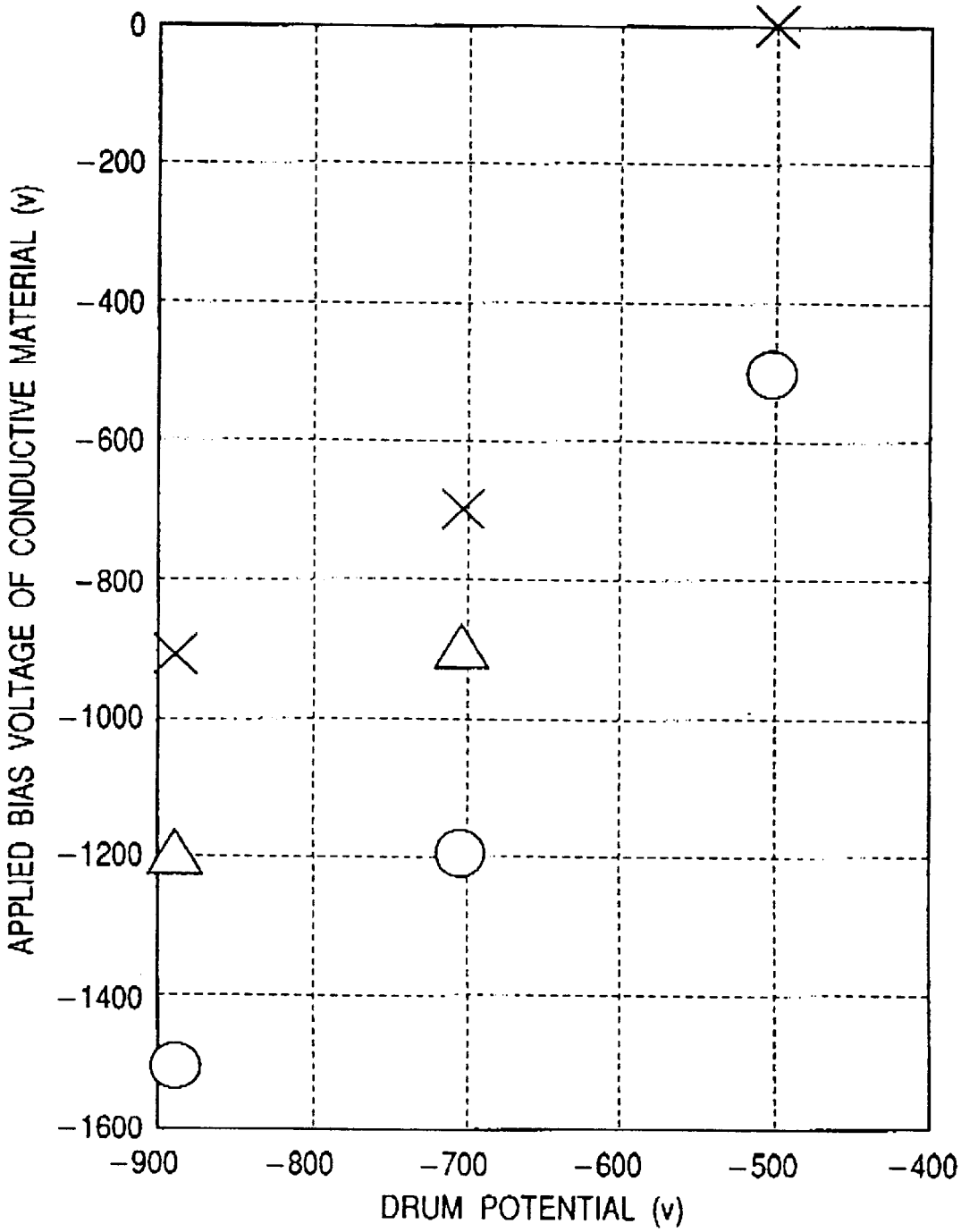
FIG. 6 is an experimental result of the first embodiment.

In FIG. 6, "o" denote no image irregularities and no toner adhering to the exposure light irradiating portion, and the "Δ" in FIG. 6 denote toner visibly adhering to the exposure light irradiating portion but no image irregularities. The "x" shape symbols denote the appearance of the image irregularities.

From the results, the exposure scattering phenomenon can be completely prevented in the structure of the tandem method image forming apparatus used in Embodiment 1 by applying a bias having the same polarity as that of the drum surface electric potential charged by the magnetic brush charging apparatus 3, and having an absolute value equal to or greater than 1500 V, to the conductive member 22 formed adjoining the exposure light irradiating portion 21 of the exposing apparatus 2.

In accordance with Embodiment 1, a problem, in which image irregularities are caused when the remaining transfer toner expelled from the magnetic brush charging apparatus 3 flies off from the surface of the photosensitive body in accordance with changes in the electric potential distribution on the surface of the photosensitive body due to image exposure light and adheres to the exposure apparatus, can be improved with the tandem method image formation apparatus in which four stations are arranged in parallel and each station performs imaging processing independently. It becomes possible to provide an image which is stable over a long period of time.

<Embodiment 2>

Figure 7:
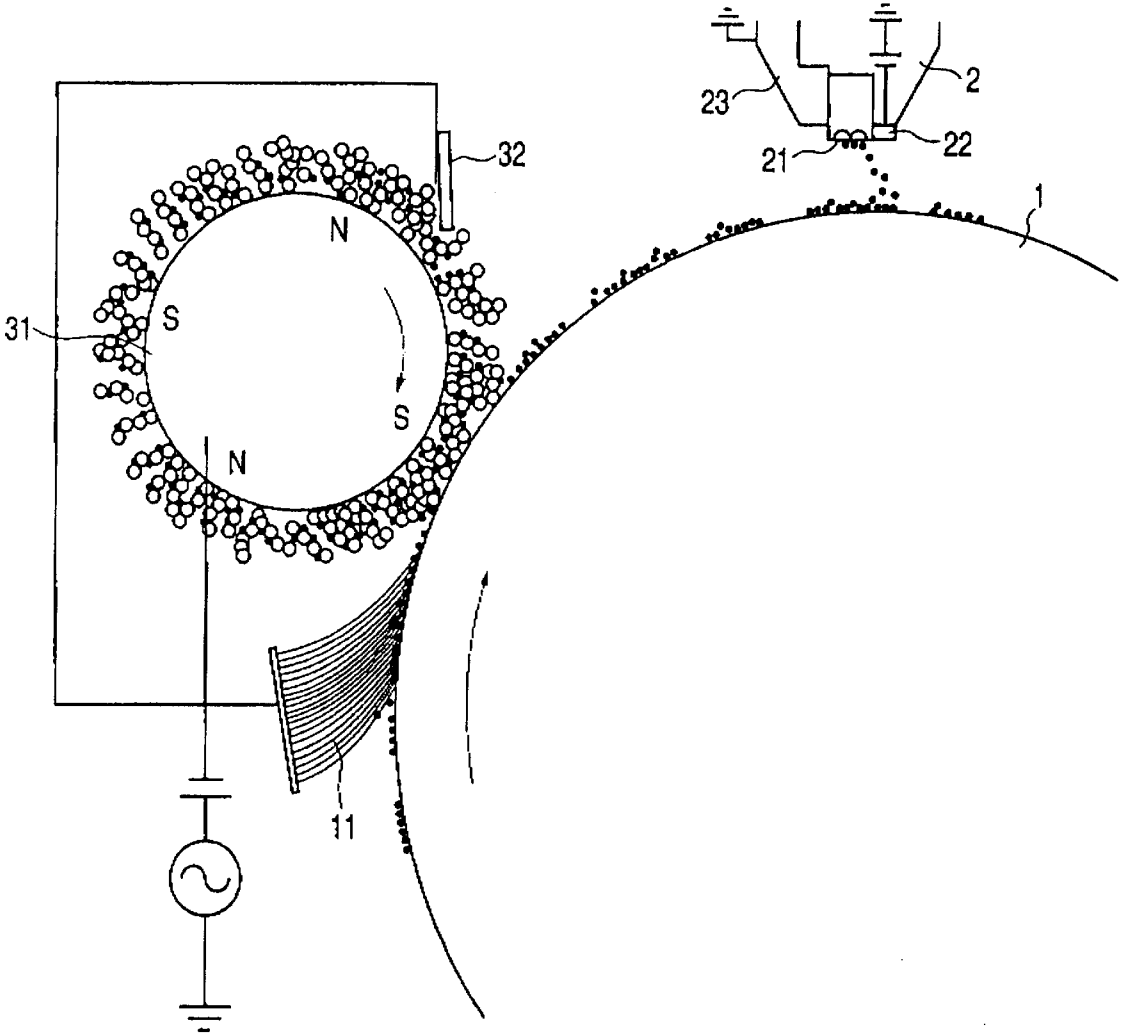
FIG. 7 is a structural diagram showing a second embodiment of the present invention.

FIG. 7 shows a second embodiment.

In Embodiment 2, a conductive member 23 is also formed upstream of the exposure light irradiating portion 21 of the exposing apparatus 2, and the conductive member 23 is grounded, as shown in FIG. 7. Other structure are similar to those of Embodiment 1.

By grounding the conductive member 23, formed upstream in the direction of rotation of the photosensitive drum 1, with respect to the exposure light emitting portion 21 of the exposing apparatus 2, the electric field in the direction of pushing the toner expelled on the photosensitive drum 1 toward the photosensitive drum 1 is additionally strengthened when a bias is applied to the conductive member 22 formed downstream in the direction of rotation of the photosensitive drum 1. The generation of the exposure scattering phenomenon can be further prevented.

Further, it also becomes possible to give a thermal irradiation effect to the conductive member 23 with respect to the exposing apparatus 2.

In accordance with Embodiment 2, a problem, in which image irregularities are caused when the remaining transfer toner expelled from the magnetic brush charging apparatus flies off from the surface of the photosensitive body in accordance with changes in the electric potential distribution on the surface of the photosensitive body due to image exposure light and adheres to the exposure apparatus, can be improved with the tandem method image formation apparatus in which four stations are arranged in parallel and each station performs imaging processing independently. It becomes possible to provide an image which is stable over a long period of time.

<Embodiment 3>

Figure 8:
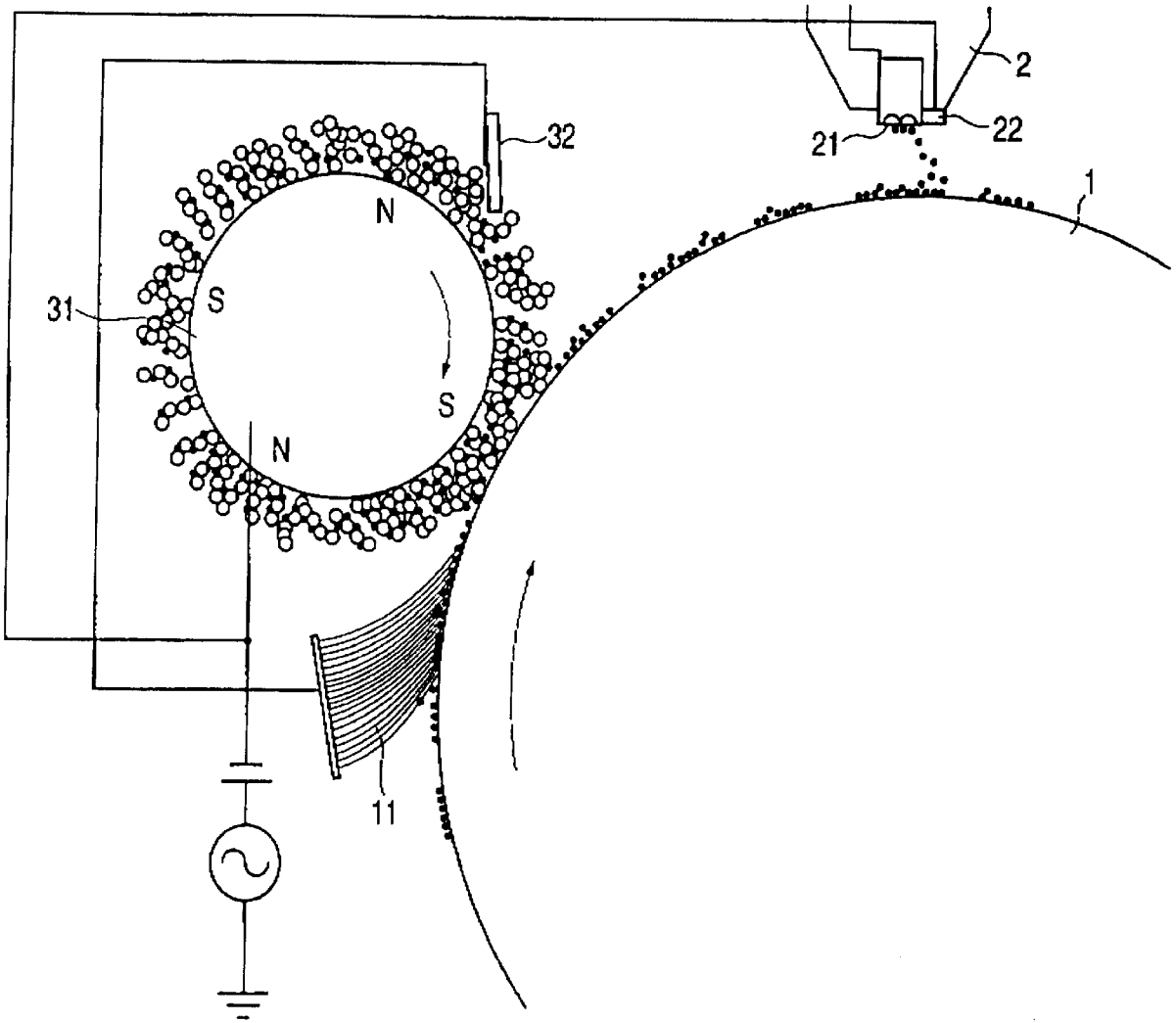
FIG. 8 is a structural diagram showing a third embodiment of the present invention.
Figure 9:
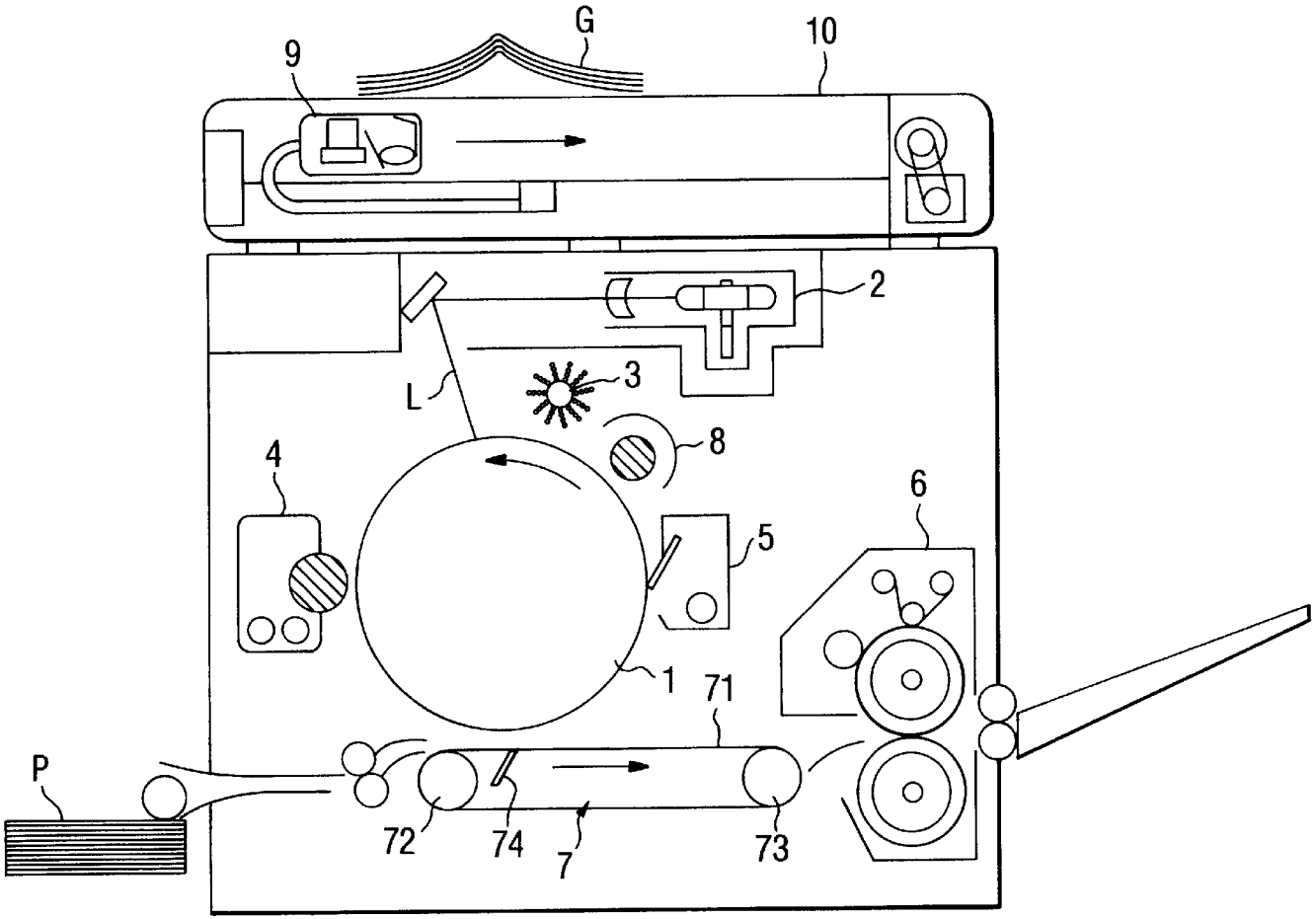
FIG. 9 PRIOR ART
FIG. 9 is a cross sectional diagram of a conventional image forming apparatus.

FIG. 8 shows a third embodiment of the present invention.

The electric power supply for the bias voltage applied to the magnetic brush charging apparatus 3 is also used as an electric power supply for the bias voltage applied to the conductive member 22 formed adjoining the exposure light irradiating portion with Embodiment 3.

The exposure scattering phenomenon can be prevented in accordance with Embodiment 3 without the addition of a new electric power supply apparatus to a conventional apparatus.

Further, the bias voltage applied to the magnetic brush charging apparatus 3 in which a direct current voltage is superimposed with an alternating current voltage may also be applied for the bias applied to the conductive member 22, and even if only the direct current component is applied, a similar effect is exhibited in effecting exposure scattering.

Note that, each of the above embodiments is explained taking a tandem type color image forming apparatus as an example, but the present invention is not limited to this type of color image forming apparatus. For example, the present invention can also be applied to a black and white single color image forming apparatus.

<Embodiment 4>

A fourth embodiment of the present invention is explained next. The structure of Embodiment 4 is similar to that of Embodiments 1 to 3, and therefore Embodiment 4 is explained using FIGS. 5, 7, and 8. In Embodiment 4, a structure is used in which the conductive member 22 is formed in parallel along the exposure light irradiating portion 21 with respect to the rotation direction of the photosensitive drum adjacent to the exposure light irradiating portion 21 of the exposure apparatus 2, as shown in FIG. 5. A bias is applied to the conductive member 22.

The electric field from the surface of the photosensitive drum toward the exposure light irradiating portion 21 becomes weaker, and an electric field works in a direction so as to push the toner expelled on the photosensitive drum 1 in the direction of the photosensitive drum 1 with this structure. The generation of exposure scattering can be prevented.

In accordance with experiments, exposure scattering can be completely prevented by setting the bias applied to the conductive member 22 formed adjoining and in parallel with the exposure light irradiating portion 21 of the exposing apparatus 2 to the same polarity as that of the charging Vd due to the magnetic brush charging apparatus 3, and at a level equal to or greater than the absolute value of Vd.

As shown in FIG. 6, the bias applied to the magnetic brush charging apparatus 3 can be utilized as a bias applied to the conductive member 22 formed adjoining and in parallel with the exposure light irradiating portion 21 with Embodiment 4. Therefore, this has the advantage that prevention of exposure scattering can be achieved without adding a new electric power source apparatus to a conventional apparatus.

The bias applied to the conductive member 22 formed adjoining and in parallel with the exposure light irradiating portion 21 of the exposure apparatus 2 is applied to the magnetic brush charging apparatus 3, and a similar effect can be exhibited in affecting exposure scattering if a bias in which a direct current voltage and an alternating current voltage are superimposed is applied, and if even only the direct current component is applied.

Further, as shown in FIG. 7, by grounding the conductive member 23 formed upstream of the exposure light irradiating portion 21 of the exposure apparatus 2, the electric field in the direction pushing the toner, which is expelled on the photosensitive drum 1, is additionally strengthened when the bias is applied to the downstream conductive member 22, and an exposure scattering phenomenon preventing effect cab be expected.

In accordance with experimental results, it is understood that the tone expelled from the magnetic brush charging apparatus 3 exists on the photosensitive drum 1, and when that region arrives at the exposure position and is exposed by the exposing apparatus 2, exposure scattering is generated. From this information, the application timing for the bias applied to the conductive member 22 formed adjoining and in parallel with the exposure light irradiating portion 21 of the exposure apparatus 2 is made synchronous with the application timing for the bias applied to the magnetic brush charging apparatus 3 with <Embodiment 4>

Figure 10:
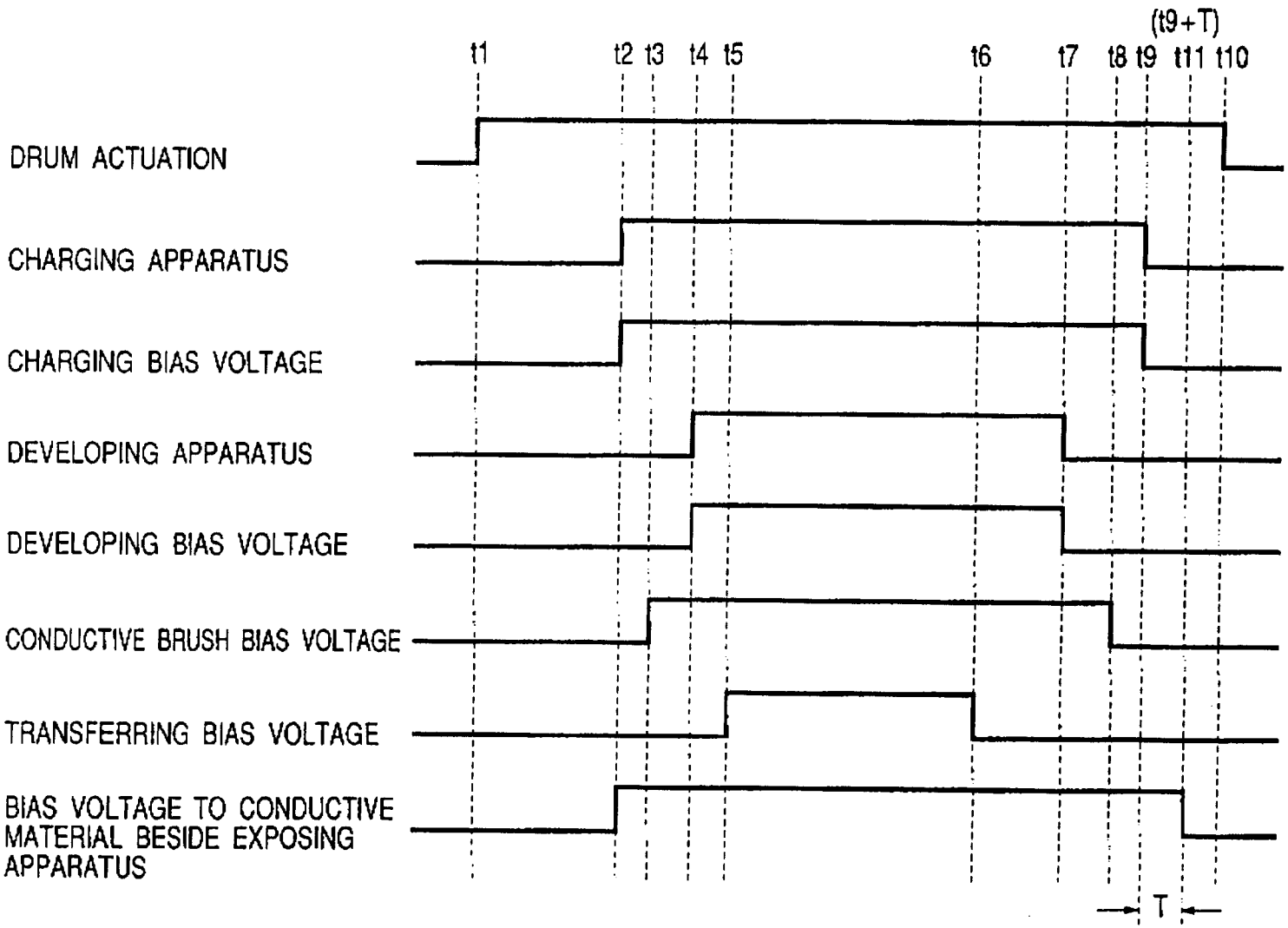
FIG. 10 is a timing chart showing an operation of a fourth embodiment of the present invention.

FIG. 10 shows a timing chart of Embodiment 4. The horizontal axis in FIG. 10 shows time. In normal operation, driving of the photosensitive drum 1 begins at a time t1, and then at a time t2 the magnetic brush charging apparatus 3 is driven and the bias is turned on. The bias is then applied to a conductive brush 11 at a time t3. Driving of the developer apparatus 4 and a bias are turned on at a time t4, and the transfer bias is applied at a time t5. Normal image formation is thus performed.

When normal image formation is complete, the transfer bias is first turned off at a time t6. Next, driving of the developer 4 and its bias are turned off at a time t7. After turning off the bias of the conductive brush 11 at time t8, driving of the magnetic brush charging apparatus 3 and its bias are shut off at a time t9. Finally, the photosensitive drum 1 drive is stopped at a time t10 and normal image forming operations are complete.

With the structure of Embodiment 4, application of the bias to the conductive member 22 formed adjoining and in parallel with the exposure light irradiating portion 21 of the exposure apparatus 2 begin simultaneously with the turn on of the magnetic brush charging apparatus 3 drive and its bias at the time t2.

In addition, regarding the completion of the image forming operation, after the magnetic brush charging apparatus 3 drive and its bias are turned off at the time t9, the application of the bias to the conductive member 22 formed adjoining and in parallel with the exposure light irradiating portion 21 of the exposing apparatus 2 is turned off at a time t11, equal to the time t9 and a period of time T, necessary for the position at which the drive and the bias of the magnetic brush charging apparatus 3 on the photosensitive drum 1 are turned off to pass by the exposing apparatus 2.

Figure 11:
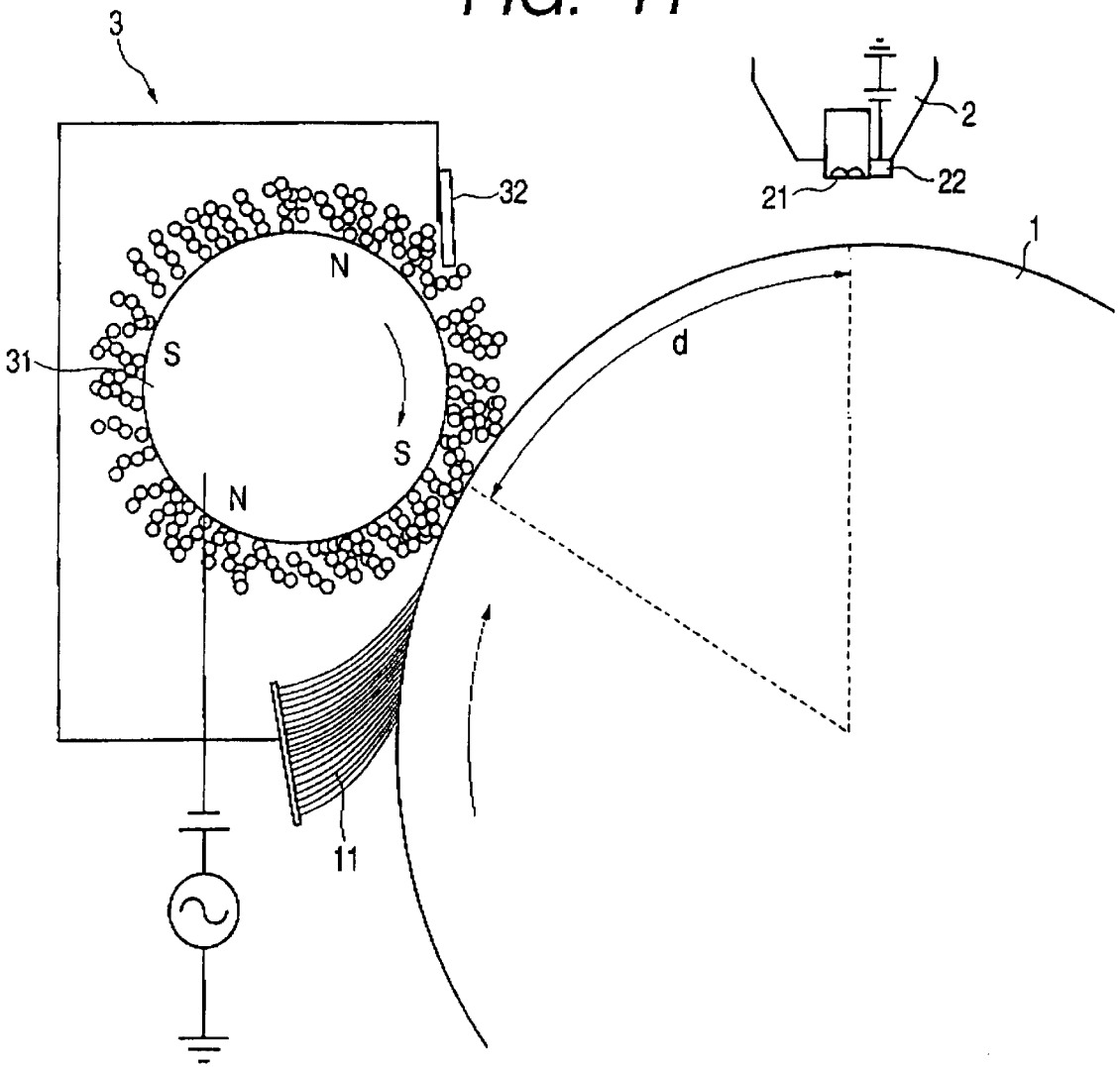
FIG. 11 is a structural diagram for explaining an operation of FIG. 10.

The time T is the time period required for the photosensitive drum 1 to rotate through a distance d on the photosensitive drum 1, from the position at which the magnetic brush charging apparatus 3 and the photosensitive drum 1 contact to the position of exposure by the exposing apparatus 2, as shown in FIG. 11.

During the time in which the magnetic brush charging apparatus 3, on which the toner expelled on the photosensitive drum 1 from the magnetic brush charging apparatus 3 is capable of existing, is operating, the bias is always applied to the conductive member 22 formed adjoining and in parallel with the exposure light irradiating portion 21 of the exposure apparatus 2, and therefore the exposure scattering phenomenon can be prevented with this structure.

The problem in which image irregularities occur due to the remaining transfer toner, which is expelled from the magnetic brush charging apparatus 3, flies off from the surface of the photosensitive body in accordance with changes in the electric potential distribution on the surface of the photosensitive body due to image exposure and adheres to the exposure apparatus 2 can be improved upon, and it becomes possible to provide an image which is stable over a long period of time <Embodiment 5>

In the case of the foregoing Embodiment 4, for example for a tandem method case in which four operation stations are arranged in parallel as shown in FIG. 1 and in which imaging operations are performed by each station independently, control becomes complicated because this is a structure in which the timing for applying a bias to the conductive members 22 formed adjoining and in parallel with the exposure light irradiating portion 21 of the exposure apparatus 2 must be set independently for each imaging station.

The timing for applying the bias to the conductive member 22 formed adjoining and in parallel with the exposure light irradiating portion 21 of the exposure apparatus 2 is set to be synchronous with the driving of the photosensitive drum 1 with the structure of Embodiment 5.

Figure 12:
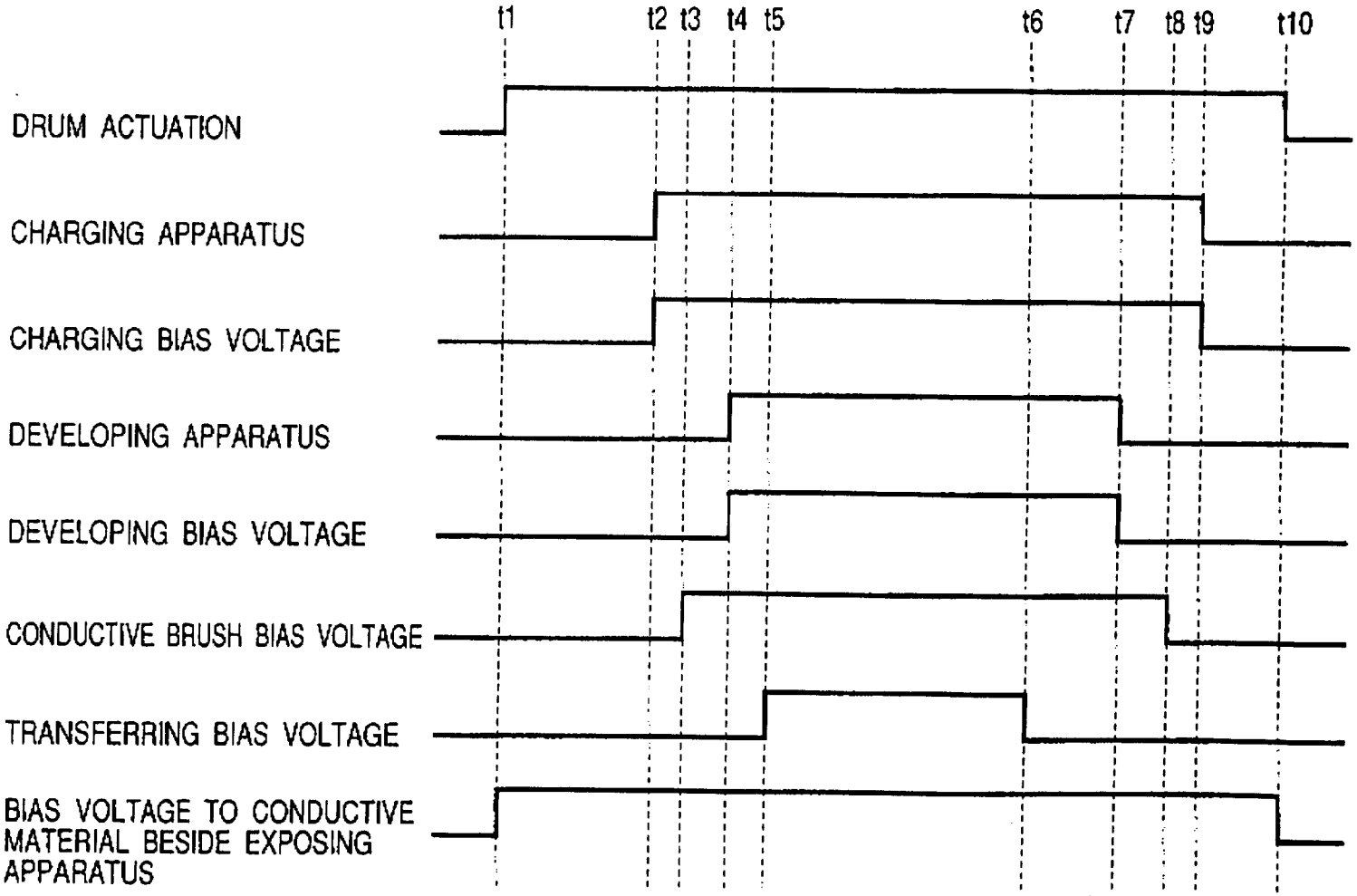
FIG. 12 is a timing chart showing an operation of a fifth embodiment of the present invention.

A timing chart of Embodiment 5 is shown in FIG. 12. The horizontal axis denotes time in FIG. 12. Normal imaging operations are similar to those of Embodiment 1.

In Embodiment 5, the application of bias to the conductive member 22 formed adjoining and in parallel with the exposure light irradiating portion 21 of the exposure apparatus 2 begins synchronously with the start of the photosensitive drum 1 drive at a time t1. The bias application to the conductive member 22 formed adjacent to and in parallel with the exposure light irradiating portion 21 of the exposure apparatus 2 is turned off synchronously with stopping the photosensitive drum 1 drive at a time t10.

During the time in which the magnetic brush charging apparatus 3, on which the toner expelled on the photosensitive drum 1 from the magnetic brush charging apparatus 3 is capable of existing, is in operation, the bias is always applied to the conductive member 22 formed adjoining and in parallel with the exposure light irradiating portion 21 of the exposure apparatus 2, and therefore the exposure scattering phenomenon can be prevented with this structure.

The problem in which image irregularities occur due to the remaining transfer toner, which is expelled from the magnetic brush charging apparatus 3, flies off from the surface of the photosensitive body in accordance with changes in the electric potential distribution on the surface of the photosensitive body due to image exposure and adheres to the exposure apparatus 2 can be improved upon, and it becomes possible to provide an image which is stable over a long period of time. In addition, control of the bias application to the conductive member 22 formed adjacent to and in parallel with the exposure light irradiating portion 21 of the exposure apparatus 2 is performed in synchronous with driving of the photosensitive drum 1, and therefore even for a case of a tandem method image forming apparatus, for example, a handy structure can be used with respect to the image forming apparatus which requires complicated control.

<Embodiment 6>

A sixth embodiment of the present invention is explained next.

1. Example of Image Formation Apparatus

Figure 13:
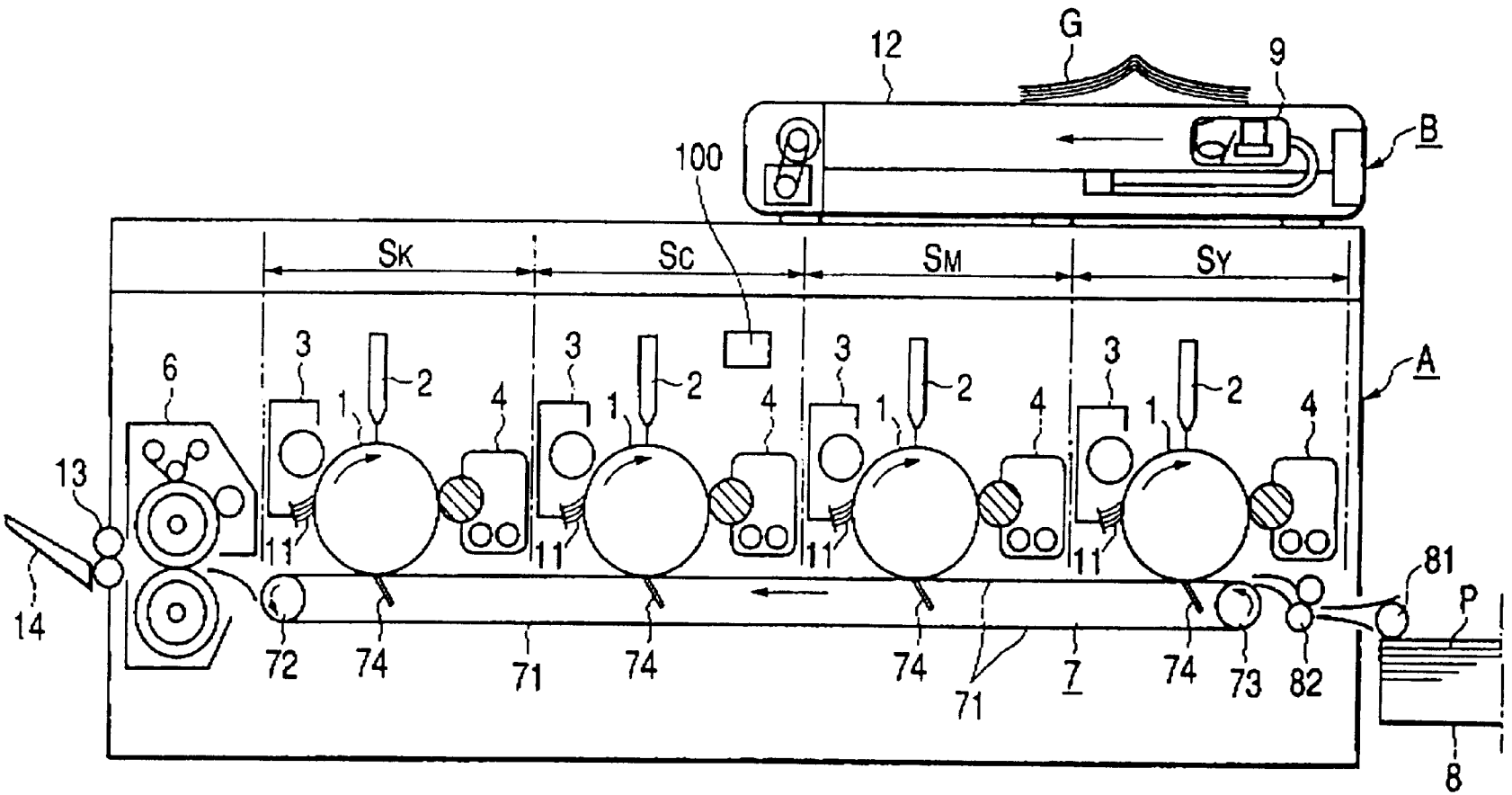
FIG. 13 is a schematic diagram of a schematic structure of an image forming apparatus of Embodiment 6.

FIG. 13 is a schematic structure diagram of an image formation apparatus in Embodiment 6. Four imaging stations are arranged in parallel in this example of an image formation apparatus, and imaging processing is performed independently by each of the imaging stations. This is a tandem method electronic photography color printer in which toner images formed by each station in one pass are combined into a full color toner image by overlapping four colors in order on a transfer material (recording material). This method has the advantage of performing color recording at high speed.

Reference symbol A denotes a color printer main body, and reference symbol B denotes a color imaging reader (color image reading apparatus) installed on the color printer main body A.

a) Color Image Reader B

The color image reader B photoelectrically reads in color resolved image information of a color subject as a time series electronic digital image signal (image signal).

Reference numeral 12 denotes a subject support glass fixed to a top surface of the apparatus, and a color subject G is arranged on the subject support glass with the surface to be duplicated facing downward. A subject pressing board, not shown in the figure, is set covering the subject.

Reference numeral 13 denotes a color read in unit in which a subject irradiation lamp, a short focal point lens array, and a CCD sensor are arranged. The unit 13 is driven, based on an operation signal, along the bottom surface of the glass from a home position shown by a solid line on the right edge below the subject stand glass 12 to the left edge. When a predetermined end point is reached, return driving begins and the unit 13 returns to its home position shown by the solid line.

In the outward driving process of the unit 13, the image surface facing downward of the subject G set on the subject stand glass 12 is irradiated by the subject irradiation lamp and scanned in order from the right edge side to the left edge side. The irradiated scanning light reflected from the surface of the subject is made incident to and imaged in the CCD sensor which has color resolving and read in functions.

The CCD sensor is structured by a light receiving portion, a transferring portion, and an output portion. Color resolved signals of the color images are converted into an electric charge signal in the CCD light receiving portion, are transferred in order to the output portion in synchronous with a clock pulse by the transfer portion, and the electric charge signals are converted into voltage signals in the output portion, amplified, made low impedance to be output. The analog signals thus obtained undergo known image processing, are converted into digital signals, and sent to a control portion, not shown in the figure, of the color printer main body A.

b) Color Printer Main Body A

Reference symbols $S_Y$, $S_M$, $S_C$, and $S_K$ denote a first through a fourth of four imaging stations (image forming portions), respectively, arranged in tandem in order from right to left.

The first imaging station $S_Y$ is a yellow toner image forming portion, the second imaging station $S_M$ is a magenta toner image forming portion, the third imaging station $S_C$ is a cyan toner image forming portion, and the fourth imaging station $S_K$ is a black toner image forming portion.

Each of the image forming stations $S_Y$, $S_M$, $S_C$, and $S_X$ is composed of a rotating photosensitive drum 1 as a body to be charged, a magnetic brush contact charging apparatus 3 as a charging means, an LED array lighter head 21 as image exposing means, a two-component contacting and reversing developing apparatus 4, a transfer portion, and a conductive brush 11 as a supplemental charging apparatus or the like as developing means. The imaging stations are cleaner-less system image forming portions.

The image exposing means 2 of the first imaging station $S_Y$ performs image exposure corresponding to the yellow component images of a full color image, and the developer apparatus 4 is a developer apparatus having yellow toner as a developer. The image exposing means 3 of the second imaging station $S_M$ performs image exposure corresponding to the magenta component images of a full color image, and the developer apparatus 4 is a developer apparatus having magenta toner as a developer. The image exposing means 3 of the third imaging station $S_C$ performs image exposure corresponding to the cyan component images of a full color image, and the developer apparatus 4 is a developer apparatus having cyan toner as a developer. The image exposing means 2 of the fourth imaging station $S_K$ performs image exposure corresponding to the black component images of a full color image, and the developer apparatus 4 is a developer apparatus having black toner as a developer.

Reference numeral 7 denotes a transfer belt apparatus in which an endless transfer belt 71 is suspended between a driver roller 72 and a follower roller 73. The transfer belt apparatus 7 is arranged beneath, and nearly parallel with, each of the first to fourth imaging stations $S_Y$, $S_M$, $S_C$, and $S_K$ arranged in tandem. The transfer belt 71 is driven to rotate in the counter clockwise direction shown by the arrow and at a predetermined peripheral velocity. On the inside of the endless transfer belt 71, a total of four transfer charging blades 74 are set, with respect to the lower surface of the photosensitive drum 1 of each imaging station $S_Y$, $S_M$, $S_C$, and $S_K$, for forming transfer nip portions which contact and place pressure on upper belt portions of the endless transfer belt 71.

Reference numeral 8 denotes a paper supply cassette in which a transfer material P is loaded and stored, reference numeral 81 denotes a supply roller, reference numeral 82 denotes a resist roller, 6 denotes a thermal fixer apparatus, 13 denotes a paper output roller, and reference numeral 14 denotes a paper output tray.

Imaging operation of the first through fourth imaging stations $S_Y$, $S_M$, $S_C$, and $S_K$ is performed, and further, the transfer material P loaded into the paper supply cassette 8 is repeatedly output one sheet at a time by the supply roller 81 and supplied. The transfer material P is supplied to the top side of the belt of the endless transfer belt 71 of the transfer belt apparatus 7 at a predetermined control timing by the resist roller 82.

The transfer material P supplied on the transfer belt 71 is maintained on the belt surface by electrostatic suction or held by a rotational vise, and accompanying rotation of the transfer belt 71 is conveyed and passed through the transfer nip portions of the first through fourth imaging stations $S_Y$, $S_M$, $S_C$, and $S_X$ in order, the yellow toner image formed in the photosensitive drum 1 is transferred by the transfer nip portion of the first imaging station $S_Y$. The magenta toner image formed in the photosensitive drum 1 is then transferred by the transfer nip portion of the second imaging station $S_M$, and the cyan toner image formed in the photosensitive drum 1 is transferred by the transfer nip portion of the third imaging station $S_C$. The black toner image formed in the photosensitive drum 1 is then transferred by the transfer nip portion of the fourth imaging station $S_K$. The intended full color image is thus formed in combination on the surface of the transfer material.

The imaging operation of the first through fourth imaging stations $S_Y$, $S_M$, $S_C$, and $S_K$ is performed in synchronous with a coordinated control timing. The toner image of each imaging station is transferred to the same surface of the transfer material conveyed by the transfer belt apparatus 7 so as to overlap in order in a predetermined position.

By applying a predetermined transfer bias to the transfer charging blades 74 of the first through fourth imaging stations $S_Y$, $S_M$, $S_C$, and $S_K$ from a transfer bias voltage application electric power source not shown in the figure, charging is performed from the bottom side of the transfer material with a polarity that is the reverse of the toner polarity. The toner images of the photosensitive drums 1 side are thus electrostatically transferred in order to the surface of the transfer material as it passes through each transfer nip portion.

The transfer material is separated from the transfer belt 71 after passing through the transfer nip portion of the fourth and final imaging station $S_K$, and is introduced to the thermal fixer apparatus 6. Image fixing is performed, and the transfer material is output as a color image formation to the output paper tray 14 on the outside of the apparatus by the output paper roller 13.

2. Photosensitive Drum 1

An object such as a normally used organic photosensitive body can be used as the photosensitive drum 1, but preferably a photosensitive body possessing a surface layer having a resistance of $10^2$ to $10^{14}$ Ωcm, and an amorphous silicon photosensitive body can used. Charge injection charging (direct contact charging) can be achieved, ozone generation is stopped, and this is effective in reducing power consumption. Further, it becomes possible to increase the charging ability.

Namely, if this type if photosensitive body is used, then it becomes possible to obtain a charging electric potential on the surface of the photosensitive body which is nearly equivalent to the direct current component from the bias applied to the contact charging member. This type of charging method is referred to as injection charging. The charging of the photosensitive body to be charged is performed without utilizing electric discharge developing using a corona charging apparatus, and therefore safe, ozone-less, low power consumption charging becomes possible provided that injection charging is used, and this method is in the spotlight.

Figure 14:
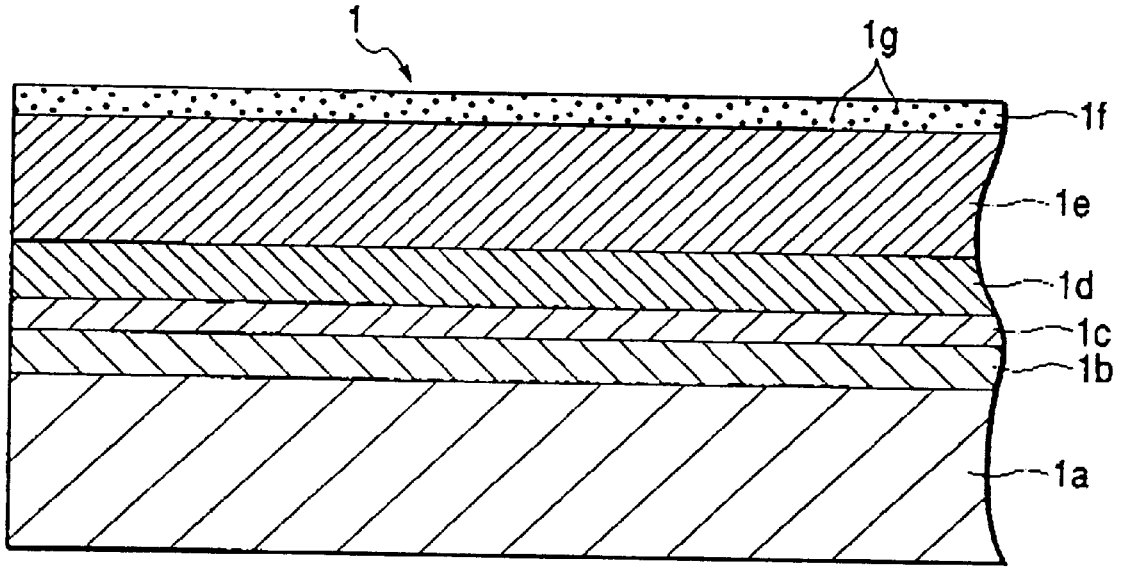
FIG. 14 is a schematic diagram of a layer of a photosensitive drum.

The photosensitive drum 1 used in Embodiment 6 is an organic photosensitive body having a negative charge on which a charge injection layer is formed on the surface. The five layers stated below, from a first layer to a fifth layer, are formed in order on an aluminum drum body having a diameter of 30 mm. FIG. 14 is a schematic diagram of the structure of the layers.

A first layer 1*b* is a base layer, and is a conducting layer having a thickness of 20 μm formed in order to average out defects and the like in the aluminum body.

A second layer 1*c* is a layer for stopping hole injection. The second layer 1*c* fulfills a role of preventing reduction of a negative electric charge on the charged surface of the photosensitive body by positive electric charge injected from the aluminum body 1*a*. The second layer 1*c* is a mid resistance layer having a thickness of 1 μm in which the resistance is regulated to be on the order of $1\times10^6$ Ωcm by amylan resin and methoxy-methyl nylon.

A third layer 1*d* is a charge generating layer, and is an approximately 0.3 μm thick layer on which a disazo pigment is distributed in a resin. A positive negative electric charge pair is generated by being exposed to light.

A fourth layer 1*e* is a charge transporting layer, and is a polycarbonite resin in which hydrozone is distributed. The fourth layer 1*e* is a p-type semiconductor. Therefore, negative electric charge on the charged surface of the photosensitive body cannot move through this layer, and only positive electric charges generated by the electric charge generating layer 14 can be transported in the surface of the photosensitive body.

A fifth layer 1*f* is a charge injecting layer, and is a coated layer of a material in which super fine $SnO_2$ particles are distributed in an insulating resin binder. Specifically, $SnO_2$ particles having a diameter of approximately 0.03 $\mu$m are doped with antimony, an insulating filler having light transmitting characteristics, and made low resistance (made conductive), and the $SnO_2$ particles are distributed into an insulating resin at 70% by weight, as the coated layer material.

This mixed coating solution is then applied with a thickness of approximately 3 $\mu$m using a suitable process such as dipping, spraying, rolling, or beam application, forming the electric charge injecting layer.

The surface resistance is $10^{13}$ Ωcm. The direct contact charging ability (injection charging ability) is increased by thus controlling the surface resistance, and a high quality image can be obtained. The photosensitive body is not limited to OPC, and can also be realized by an amorphous silicon (a-Si) drum, and in addition, high endurance can be achieved.

The volume resistivity of the surface layers is a value measured by forming a 200 $\mu$m gap between metallic electrodes, injecting the surface layer mixed solution between the electrodes and forming a film, and then applying a 100 V voltage between the electrodes. The measurements are values found at conditions of a temperature of 23° C. and a relative humidity of 50%.

3. Magnetic Brush Contact Charging Apparatus 2

A contact charging method in which charging of a body to be charged is performed by contacting a charging member, to which a voltage is applied, onto the body to be charged has advantages such as low ozone and low power. A magnetic brush method apparatus is preferably used because of its stable charging contact. With a magnetic brush method contact apparatus (injecting charging apparatus), conductive magnetic particles are magnetically restrained as a magnetic brush directly on a magnet, or on a sleeve in which a magnet is wrapped. The magnetic brush, while stopped or while rotating, is made to contact the body to be charged, and charging begins in accordance with application of a voltage.

Figure 15:
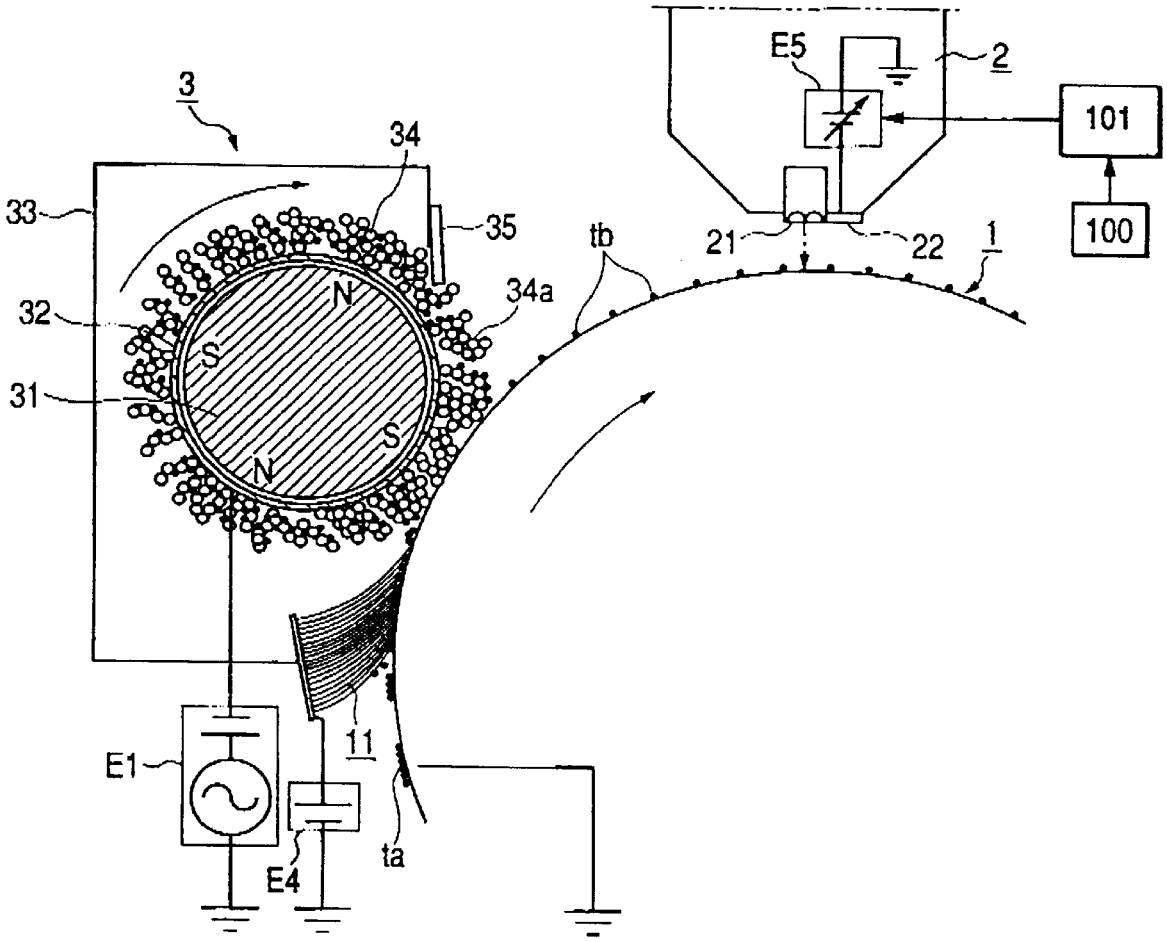
FIG. 15 is a schematic diagram of a schematic structure of a magnetic brush contact charging apparatus and an image exposure apparatus.

FIG. 15 is a schematic cross sectional diagram showing a schematic structure of a magnetic brush contact charging apparatus 3. The charging apparatus of Embodiment 6 is a sleeve rotating type.

Reference numeral 33 denotes a charging container (housing), reference numeral 32 denotes a non-magnetic sleeve as a magnetic particle holding body (hereafter referred to as a charging sleeve), a portion of the periphery is exposed outside the charging container 33, and the inside of the charging vessel is set to freely rotate.

Reference numeral 31 denotes a magnet roller (permanent magnet roller) as a magnetic field generating member, and the magnet roller 31 is introduced into the interior of the charging sleeve 32. The magnet roller 31 is a non-rotating fixed member, and the charging sleeve 32 is driven rotationally, by a drive system not shown in the figure, so as to rotate around the fixed magnet roller 31 on the same axis in a clockwise direction shown by the arrow, at a predetermined peripheral speed. The rotation is counter to that of the photosensitive drum 1.

Reference numeral 34 denotes carrying magnetic particles contained within the charging container 33 (hereafter referred to as a magnetic carrier), and reference numeral 35 denotes a regulating blade as magnetic particle regulation means set in an open portion of the charging container 33 having a predetermined gap with respect to the charging sleeve 32. The magnetic carrier 34 within the charging container 33 is magnetically restricted and supported on the outside surface of the charging sleeve 32 as a magnetic brush in accordance with the magnetic field of the magnet roller 31 on the inside of the sleeve. The magnetic carrier is rotationally conveyed along with the rotation of the charging sleeve 32, and by passing through the gap (S–B gap) between the charging sleeve 32 and the regulating blade 25, the layer thickness is regulated in a predetermined manner, and the magnetic carrier 34 is carried out to the outside of the charging container 33. Reference numeral 34 denotes the magnetic brush.

The charging sleeve 32 is set opposite with a gap having a smaller layer thickness than that of the regulated magnetic brush 34*a* is opened with respect to the photosensitive drum 1. Therefore, the layer thickness is regulated by the regulating blade 35, and the magnetic brush 34*a* which is conveyed to the opposing gap portion between the charging sleeve 32 and the photosensitive drum 1 (S–D gap) by the rotation of the charging sleeve 32 contacts the surface of the photosensitive drum 1 over its width, is moved in a direction which is the reverse of the motion direction of the photosensitive drum 1 surface, and slides contacting the surface of the photosensitive drum 1. The sliding portion is a charging nip portion.

The magnetic brush 34*a*, having passed through the opposing gap portion between the charging sleeve 32 and the photosensitive drum 1, is conveyed so as to be returned within the charging container 33 by the continuing rotation of the charging sleeve 32, and this repeats cyclically.

The charging sleeve 32 is rotated, and an electric charge is imparted on the photosensitive drum 1 from the charging carrier structuring the magnetic brush 34*a* in the charging nip portion in accordance with application of a predetermined charging bias voltage to the charging sleeve 32 from a charging bias voltage application electric power source E1. The surface of the rotating photosensitive drum 1 is contact charged to a value near the electric potential corresponding to the applied charging voltage.

It is preferable to use a magnetic carrier having an average particle diameter of 10 to 100 $\mu$m, a saturation magnetization of 20 to 250 emu/cm$^3$, and a resistance of $1\times10^2$ to $1\times10^{10}$ Ωcm as the charging magnetic carrier 34, and if insulation defects such as pin holes exist in the photosensitive drum 1, then it is preferable to use a magnetic carrier having a resistance equal to or greater than $1\times10^6$ Ωcm. It is good to use a magnetic carrier having as small a resistance as possible in order to have good charging performance, and therefore magnetic particles having an average diameter of 25 $\mu$m, a saturation magnetization of 200 emu/cm$^3$, and a resistivity of $5\times10^6$ Ωcm are used in Embodiment 6. Further, a magnetic carrier to which resistance regulation is performed by oxidation and reduction processing of the surface of ferrite is used in Embodiment 6.

4. Developer Apparatus 4

In general, electrostatic latent image toner developing methods are roughly divided into the following four types.

1) A method of developing in which a non-magnetic toner is coated onto a sleeve such as a blade, and a magnetic toner is coated in accordance with a magnetic force, and transported. This is a development method in which there is a state of non-contact with respect to the photosensitive body (single component non-contact developing).
2) A method in which toner coated as stated above is exposed in a state of contact with respect to the photosensitive body (single component contact developing).
3) A method in which a magnetic carrier is mixed with toner particles to be used as a developer, and transported in accordance with a magnetic force and developed in a state of contact with the photosensitive body (two-component contact developing).
4) A method in which the above two-component developer is in a state of non-contact with the photosensitive drum is a fourth method (two-component non-contact developing).

From among the four methods, the two-component contact developing method is often used from the standpoint of high image quality and high stability.

Figure 16:
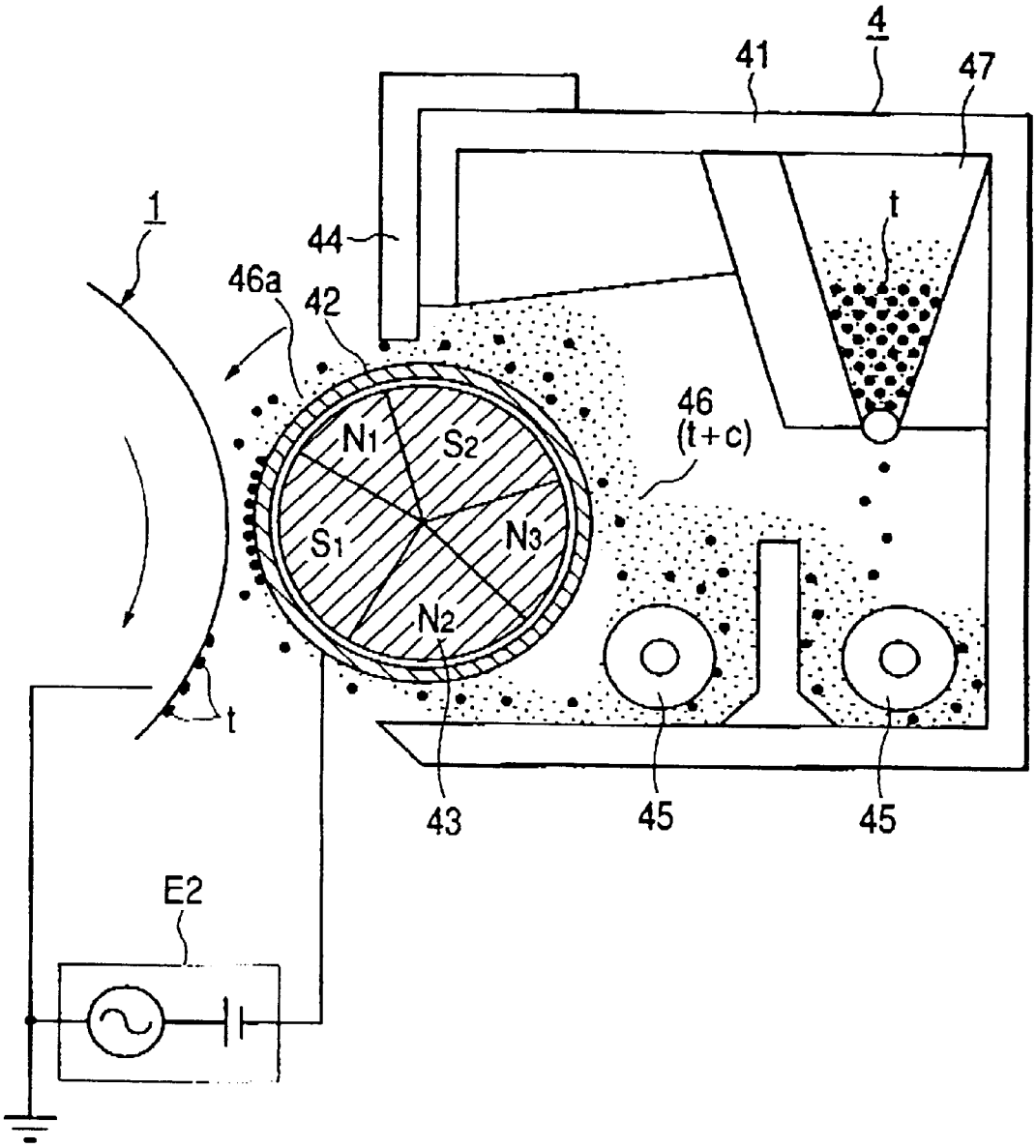
FIG. 16 is a schematic diagram of a schematic structure of a developer apparatus.

FIG. 16 is a schematic diagram of the developer apparatus 4 used in Embodiment 6. A developer in which non-magnetic toner particles and magnetic carrier particles are mixed is used as a developer for the developer apparatus 4 of Embodiment 6. The developer apparatus 4 of Embodiment 6 is a two-component magnetic brush contact developing method apparatus in which the developer is maintained as a magnet brush layer in accordance with a magnetic force from a developer supporting body, the developer is transported to a developer portion and is contacted to the surface of the photosensitive drum 1, and an electrostatic latent image is developed as a toner image.

Reference numeral 41 denotes a developer container, reference numeral 42 denotes a developer sleeve as a developer supporting body, reference numeral 43 denotes a magnet roller fixed and arranged within the developer sleeve 42 as means of generating a magnetic field, and reference numeral 44 denotes a developer thickness regulating blade for forming a thin film of developer on the surface of the developer sleeve. Reference numeral 45 denotes a developer agitator screw, and reference numeral 46 denotes a two-component developer contained within the developer container 41. The developer is a mixture of non-magnetic toner particles t and magnetic carrier particles c.

The developer sleeve 42 is arranged such that the nearest contact region becomes approximately 500 $\mu$m with respect to the photosensitive drum 1 at least during the time of development, and is set such that the developer magnetic brush thin layer 46*a* supported on the outside surface of the developer sleeve 42 contacts the surface of the photosensitive drum 1. The developer magnetic brush layer 46*a* and the contact nip portion of the photosensitive drum 1 are a developing region (developer portion).

The developer sleeve 42 is driven at a predetermined rotational velocity in a counter clockwise direction shown by the arrow around the outside of the fixed magnet roller 43. The magnetic brush of the developer 46 is formed within the developer container 41 in accordance with the magnetic force of the magnet roller 43 on the outer surface of the sleeve. The developer magnetic brush is conveyed along with the rotation of the sleeve 42, has its layer thickness regulated by the blade 44, is held out on the outside of the developer container as the developer magnetic brush thin layer 46*a* having a predetermined layer thickness, is conveyed to the developer portion, and contacts the surface of the photosensitive drum 1. The developer magnetic brush thin film 46*a* is then conveyed and returned within the developer container 41 once again by continuing rotation of the sleeve 42.

Namely, the developer 46 is first drawn up by an N3 pole of a magnet roller 43 accompanying rotation of the developer sleeve 42, and in a process of being conveyed from an S2 electrode to an N1 electrode, is regulated in accordance with the regulating blade 44 arranged perpendicular with respect to the developer sleeve 42, forming the thin layer 46*a* of the developer 46 on the developer sleeve 42. When the developer layer 46*a* is conveyed to a developer main electrode S1 of the developer portion, standing spikes are formed in accordance with a magnetic force. The electrostatic latent image of the photosensitive drum 1 is developed as a toner image by the developer layer 46*a* formed into the spike shapes, and the developer on the developer sleeve 42 is then returned to within the developer container 41 by a repelling magnetic field of electrodes N2 and N3.

A direct current (DC) voltage and an alternating current (AC) voltage are applied to between the developer sleeve 42 and the conductive drum body of the photosensitive drum 1 from a developer bias application electric power supply E2.

In Embodiment 6, a developer bias consisting of:

direct current voltage:−480 V;

alternating current voltage:amplitude Vpp=1500 v, frequency Vf=3000 Hz is applied. In the developer portion, the toner t within the developer magnetic brush thin layer 46*a* on the developer sleeve 42 side selectively adheres to the electrostatic latent image of the photosensitive drum 1 side, and the electrostatic latent images is developed as a toner image.

In general, the developing efficiency increases if an alternating current voltage is applied in a two-component developing method, and the image becomes high quality, but on the other hand, there is a danger in that the image more easily becomes blurry. Normally, therefore, the image is prevented from becoming blurry in accordance with setting an electric potential difference between the direct current voltage applied to the developer apparatus 4 and the surface electric potential of the photosensitive drum 1.

The electric potential difference for preventing blurriness is referred to as a blur removing electric potential Vback, and the toner is prevented from adhering to non-image regions during developing by this electric potential difference.

The toner concentration of the developer 46 within the developer container 41 (mixture ratio to the carrier) is reduced little by little as the toner portion is consumed in developing the electrostatic latent images. The toner concentration of the developer 46 within the developer container 41 is detected by detecting means not shown in the figure, and if the concentration drops to a predetermined minimum permissible concentration, then the toner t is supplied from a toner supply portion 47 to the developer 46 within the developer container. Toner supply is controlled so that the toner concentration in the developer within the developer container 41 is always maintained within a predetermined permissible range.

The two-component developer 46 used in Embodiment 6 is a mixture of:

toner particles t: negatively charged toner particles manufactured in accordance with a grinding process and having an average diameter of 6 $\mu$m to which 1% by weight of titanium oxide particles having an average diameter of 20 nm are added around the toner particles;

carrier particles c: average particle diameter of 35 μm and having a saturation magnetization of 205 emu/cm$^3$;

The toner particles t and the carrier particles c are mixed at a weight % ratio of 6 to 94.

The toner within the developer 46 at this time has a triboelectrifaction of approximately $25\times10^{-3}$ c/kg.

5. Transfer Belt Apparatus 7

A polyimide resin belt having a film thickness of 75 μm is used as the belt 71 (FIG. 13) in Embodiment 6.

The belt 71 material is not limited to polyimide resin, and an appropriate material such as: a plastic such as polycarbonite resin, polyethylene terephthalate resin, polyfluoride vinylidine resin, polyethylene naphthalate resin, polyether ether ketone resin, polyether sulphone resin, and polyurethane resin; a fluoride; and a silicon rubber can be used. The film thickness is also not limited to 75 μm, and a thickness substantially from 25 to 2000 μm, preferably between 50 and 150 μm, can be used.

In addition, a material having a resistance of $1\times10^5$ to $1\times10^7$ Ω is used as the transfer charging blade 74. A +15 μA bias is applied to the transfer charging blade 74 in accordance with constant electric current control, and transfer is performed.

6. Conductive Brush 6

In Embodiment 6, the conductive brush 6 as a supplemental charging apparatus is attached to the charging container 21 of the magnetic brush contact charging apparatus 2 and maintained as shown in FIG. 15. The brush portion is set so as to contact the surface of the photosensitive drum 1 further upstream in the direction of rotation of the photosensitive drum than the charging nip portion, which is the contact portion between the magnetic brush 24*a* and the photosensitive drum 1; and further downstream in the direction of rotation of the photosensitive drum than the transfer nip portion. A conductive fiber brush member (hair density 100,000/in$^2$, resistance $5\times10^6$ Ω) having a hair length of 6 mm, an incursion amount of approximately 1 mm, and a contact nip with the photosensitive drum of approximately 3 mm is used for the conductive brush in Embodiment 6. A voltage of +500 V having a polarity which is opposite that of the DC charging polarity of the magnetic brush charging apparatus is applied from the electric power source E4 to the conductive brush 6 in Embodiment 6.

7. Structure of Exposure Scattering Phenomenon Prevention Means

In a cleaner-less system image formation apparatus, remaining transfer toner tb which is expelled onto the photosensitive drum 1 after being recovered by the magnetic brush contact charging apparatus 2 flies off from the surface of the drum, is pulled in the direction of an exposing surface 21 of an image exposure apparatus 3, and adheres to the exposing surface 21 of the image exposing apparatus 2 due to an electric field accompanying changes in the electric potential of the surface of the photosensitive drum when exposure is performed in accordance with the image exposure apparatus 3 in the next step. The exposure scattering phenomenon is thought to develop by changes in the electric potential distribution on the surface of the photosensitive drum due to receiving exposure light.

The applicants of the present invention performed an experiment in which 4% toner is forcibly mixed into the magnetic carrier 24 of the magnetic brush contact charging apparatus 3 with the printer structure used in Embodiment 6, and then this toner is forcibly expelled to the photosensitive drum while performing exposure of light over the entire surface.

The developer 46 was not input to the developer apparatus 4 in this experiment, and driving of the developer apparatus 46 and bias current application were not performed. The electric potential Vd of the surface of the photosensitive drum after charging (dark portion electric potential) was set constant at −800 V, and by changing the electric potential V1 of the surface of the photosensitive drum after exposure (bright portion electric potential), an experiment was performed in which the latent image contrast, the difference between Vd and V1, was changed.

The experimental results make clear that the smaller the latent image contrast, the more that the toner tb expelled onto the photosensitive drum 1 from the magnetic brush 34*a* of the magnetic brush contact charging apparatus 3 flew off in a direction perpendicular to the direction of the exposing surface 21 of the image exposing apparatus 2. Thus for a case in which the latent image contrast under actual operating conditions is small, namely when half tone exposure is performed, the exposure scattering phenomenon develops conspicuously. The exposing surface 21 of the image exposing apparatus 2 is shielded by adhering toner when the exposure scattering phenomenon develops, and therefore an appropriate amount of exposure light cannot be imparted to the photosensitive drum by portions of the exposing surface 21 to which the toner adheres. An image irregularity in which the image is lost develops.

In order to prevent this type of exposure scattering phenomenon, a structure is used in which a conductive member 32 is formed adjoining the exposing surface 21 of the image exposing apparatus 2, and downstream with respect to the direction of rotation of the photosensitive drum, as shown in FIG. 15. A bias is applied to the conductive member 22 from the electric power source E5. The applied bias has a minus polarity, the same polarity as that of the photosensitive drum 1.

The electric field from the surface of the photosensitive drum 1 toward the direction of the exposing surface 21 of the image exposing apparatus 2 becomes weaker in accordance with the structure of Embodiment 6, and the electric field works on the toner t6 expelled from the magnetic brush 34*a* of the magnetic brush contact charging apparatus 3 and onto the photosensitive drum 1 in a direction pushing the toner in the direction of the photosensitive drum 1, and the development of the exposure scattering phenomenon can be prevented.

Figure 17:
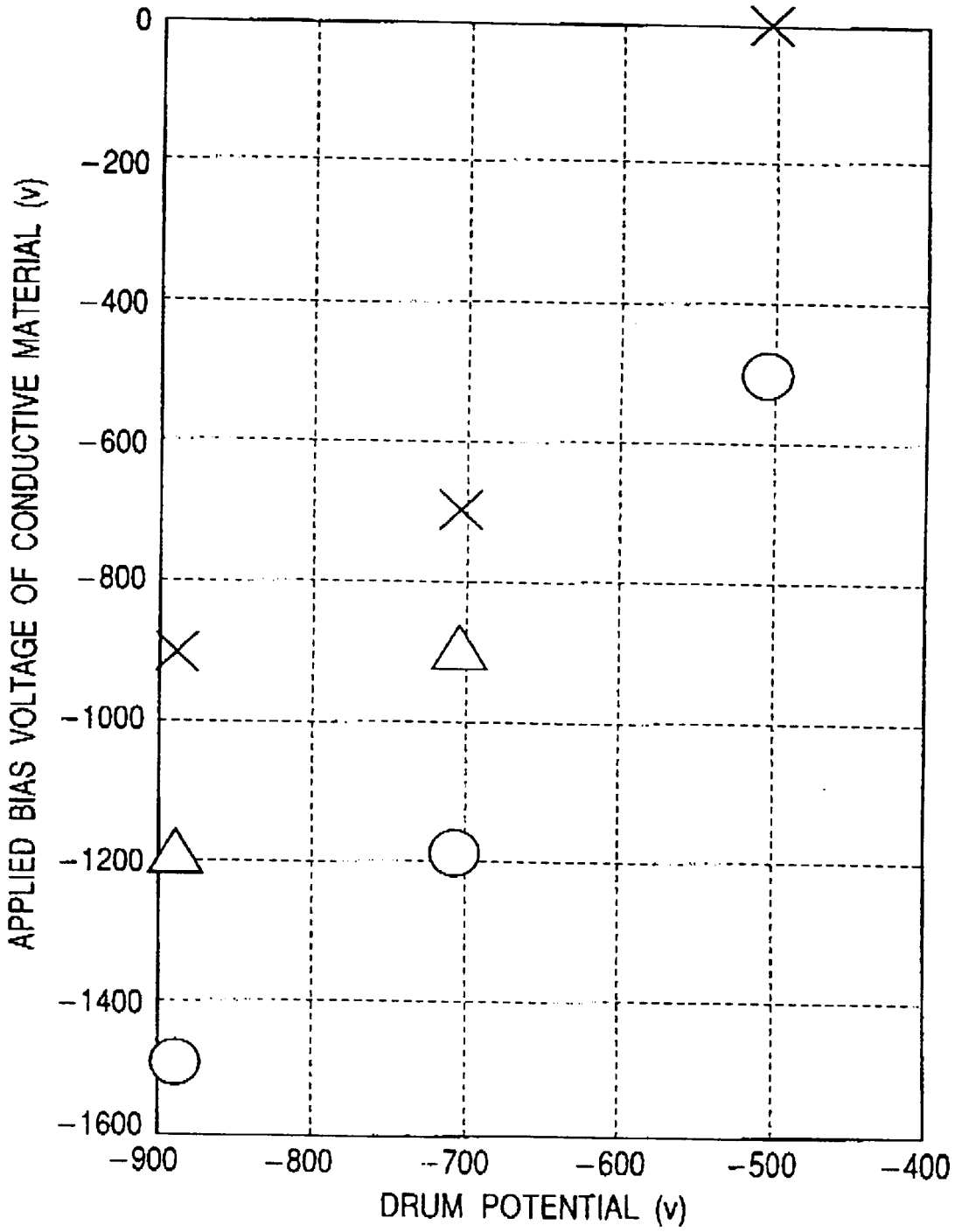
FIG. 17 is a graph of a correlation between surface electric potential of a photosensitive drum and bias voltage applied to a conductive member.

Endurance experiments were performed in which the electric potential Vd of the surface of the photosensitive drum, charged by the magnetic brush contact charging apparatus 3 of the second imaging station $S_M$ of the tandem method is approximately −500 V, −700 V, and −900 V, and the bias applied to the conductive member 22 formed adjoining the exposure surface 31 of the image exposure apparatus 3 is set to 0 V, −500 V, −700 V, −900 V, −1200 V, and −1500 V. The experimental results obtained with regard to the effects of preventing exposure scattering for each of these cases are shown in FIG. 17.

The circular symbols within the figure denote no image irregularities and no toner adhering to the exposure surface 31, and the triangular symbols denote toner visibly adhering to the exposure surface 31 but no image irregularities seen. The x shape symbols denote the appearance of the image irregularities.

From these results, it is understood that the bias applied to the conductive member 32 formed adjoining the exposing surface 21 of the image exposing apparatus 2 correlates to Vd.

Figure 18:
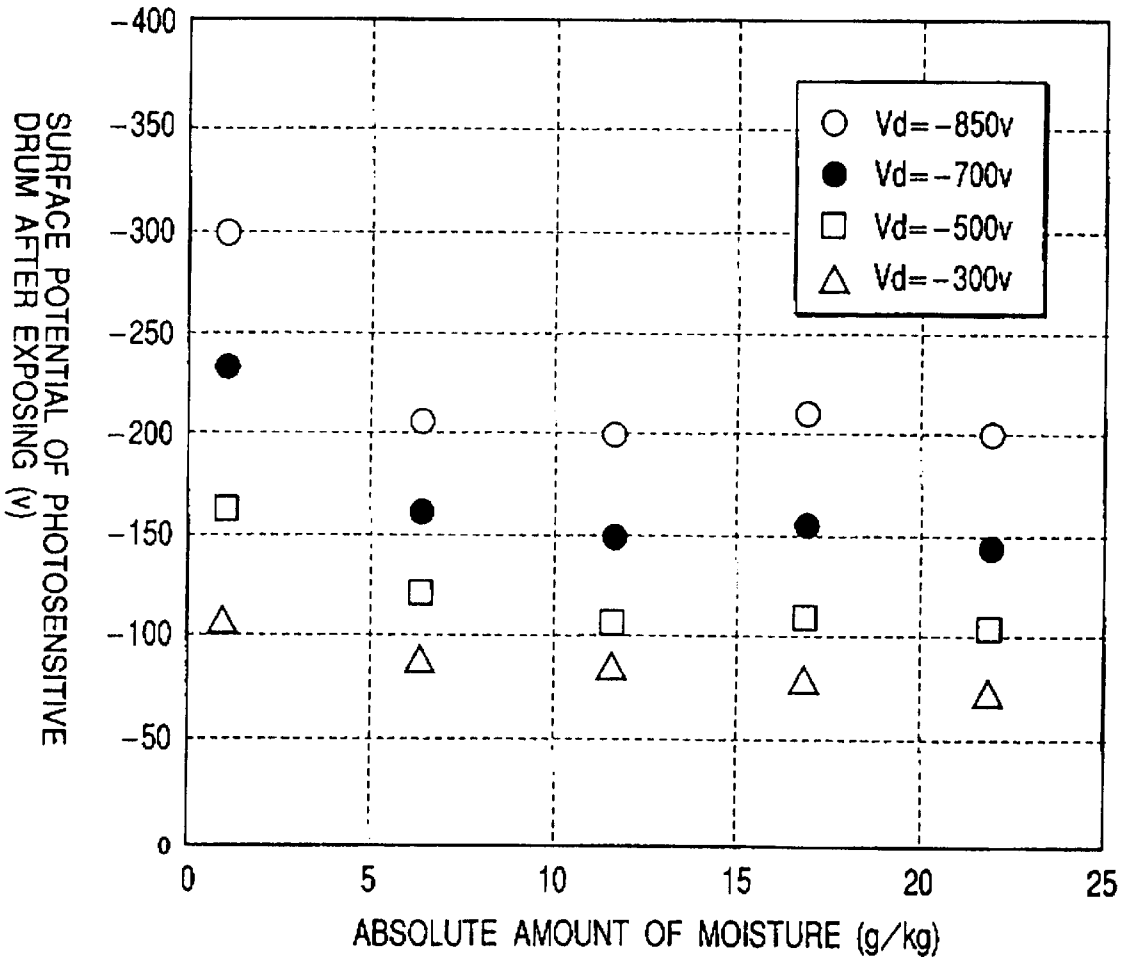
FIG. 18 is a graph of a correlation of surface electric potential of a photosensitive drum after exposure with respect to absolute amount of moisture.
Figure 19:
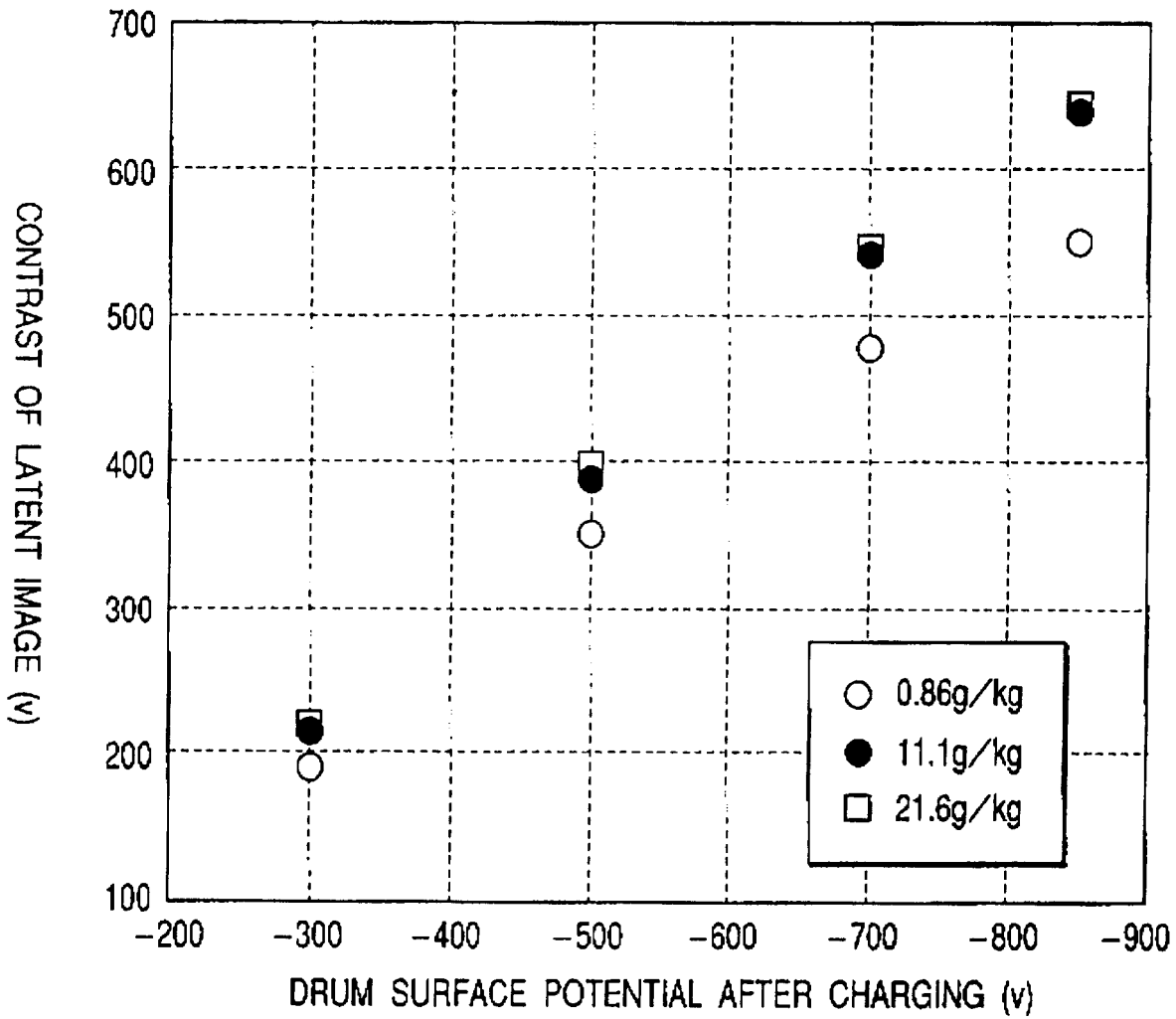
FIG. 19 is a graph of latent image contrast with respect to surface electric potential of a photosensitive drum after changing.

Shown in FIG. 18 is a graph in which the surface electrical potential V1 of the photosensitive drum after exposure is plotted with respect to the absolute amount of moisture in the atmosphere for values of the electric potential of the surface of the photosensitive drum Vd after charging. FIG. 19 is obtained from FIG. 18. FIG. 19 is a graph in which the latent image contrast (Vd–V1) is plotted with respect to the dark portion electric potential Vd for amounts of absolute moisture in the atmosphere. From FIG. 19, is understood that the lower the amount of absolute moisture in the atmosphere, the lower the necessary latent image contrast becomes.

Figure 20:
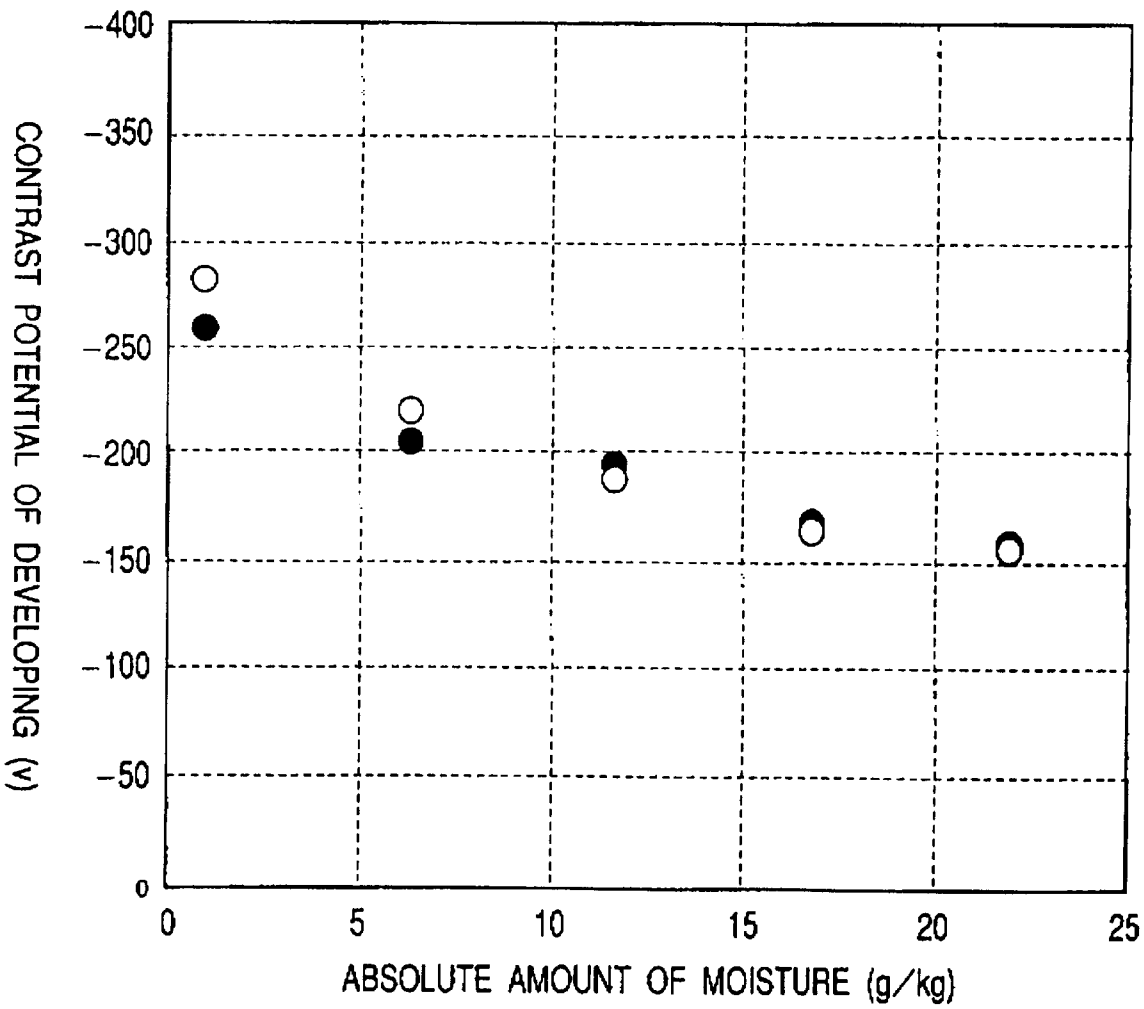
FIG. 20 is a graph of development contrast with respect to an absolute amount of moisture.

Further, FIG. 20 is similarly a graph of the developer contrast electric potential (Vcont) with respect to the absolute amount of moisture in the atmosphere, and from the figure, it is understood that the lower the absolute amount of moisture in the atmosphere, the more the contrast electric potential of the developer increases.

Therefore, with a small absolute amount of moisture in the atmosphere, namely in a dry environment, it is necessary to make the dark portion electrical potential Vd, which is the electric potential of the photosensitive drum surface after charging, large in order to satisfy the exposure concentration and obtain a stable image. However, as shown in FIG. 17, accompanying an increase in the dark portion electric potential Vd, it becomes necessary to increase the size of the bias applied to the conductive member 22 formed adjoining to the exposure surface 21 of the image exposing apparatus 2.

Based on these results, a structure is used in which an environmental sensor 100 for obtaining temperature and humidity information with the main body of the printed is arranged in Embodiment 6 (FIGS. 13 and 15). Detection information is input to a control circuit 101, and the electric power source E5 is controlled by the control circuit 101 based upon the information obtained from the environmental sensor 100. The value of the bias applied to the conductive member 22 formed adjoining the exposure surface 21 of the image exposing apparatus 2 is thus changed.

In Embodiment 6, the control circuit 101 selects a value for the bias applied to the conductive member 22 from an environmental table, determined in advance, based upon an absolute amount of moisture h obtained from the environmental sensor 100, and controls the electric power source E5.

Exposure scattering can thus be completely prevented in the tandem method image formation apparatus structure used in Embodiment 6.

In accordance with embodiment 6, a problem, in which image irregularities are caused when the remaining transfer toner tb expelled from the magnetic brush contact charging apparatus 3 flies off from the surface of the photosensitive body in accordance with changes in the electric potential distribution on the surface of the photosensitive body due to image exposure light and adheres to the exposing surface 21 of the exposing apparatus 2, can be improved with the tandem method image formation apparatus in which four stations are arranged in parallel and each station performs imaging processing independently. It becomes possible to provide an image which is stable over a long period of time in all environmental conditions.

Figures 21, 22:
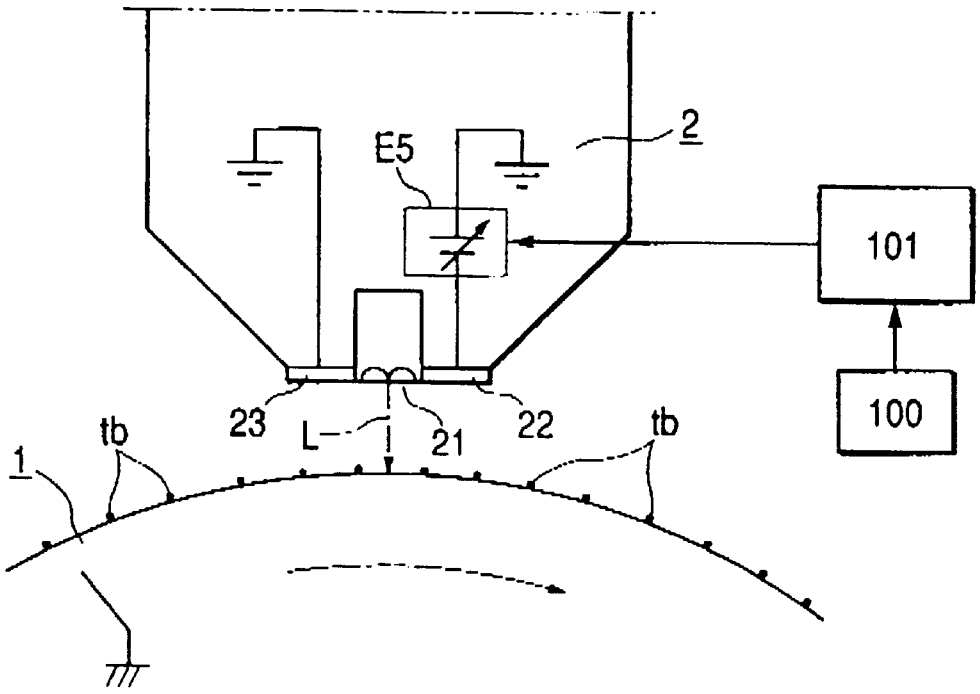
FIG. 21 is an environmental table content formed in a control circuit.
FIG. 22 is a schematic diagram of a schematic structure of an example forming a conductive member in a downstream side and in an upstream side with respect to a rotation direction of a photosensitive drum adjoining an exposure face of an image exposure apparatus.

FIG. 22 is a structure in which a conductive member 22 is formed adjoining the exposure surface 21 of the image exposing apparatus 2, parallel along the exposure surface 21, and upstream with respect to the rotation direction of the photosensitive drum. This structure is also effective in preventing exposure scattering. Namely, by grounding the conductive member 23 of the upstream side, the electric field in the direction pushing the toner tb, expelled from the magnetic brush 34*a* of the magnetic brush contact charging apparatus 3 and onto the photosensitive drum 1 is further strengthened. An effect of preventing exposure scattering development is seen.

8. Other

1) The contact charging member of the contact charging means is not limited to the conductive magnetic particle magnetic brush contact charging member, and other conductive charging members such as a conductive roller using a conductive rubber or a conductive sponge, and a fur brush contact charging member may also be used. The contact charging member may also be fixed with no rotation.
2) The waveform of the voltage for cases of including an alternating current voltage (AC voltage) in the bias with respect to the charging means or the developer means may be suitable determined from waveforms such as a sine wave, a rectangular wave, and a triangular wave. A rectangular wave formed by turning a direct current electric power source on and off periodically may also be used. A bias in which the type of voltage waveform is periodically changed can thus be used as the alternating current voltage waveform.
3) The image exposing means for reading in and forming the electrostatic latent image is not limited to an LED array writer head, as in the embodiments, and means capable of image exposure corresponding to image information, such as laser scanning exposing means and analog image exposing means, can also be used.
4) The image formation apparatus may also be one using a method of intermediate transfer of a toner image formed of intermediate transfer of a toner image formed and held on the photosensitive drum to an intermediate transfer body. The image forming apparatus may of course also be a single color image forming apparatus, not only a color image forming apparatus.

<Embodiment 7>

Subsequently, a seventh embodiment of the present invention will be described.

Figure 23:
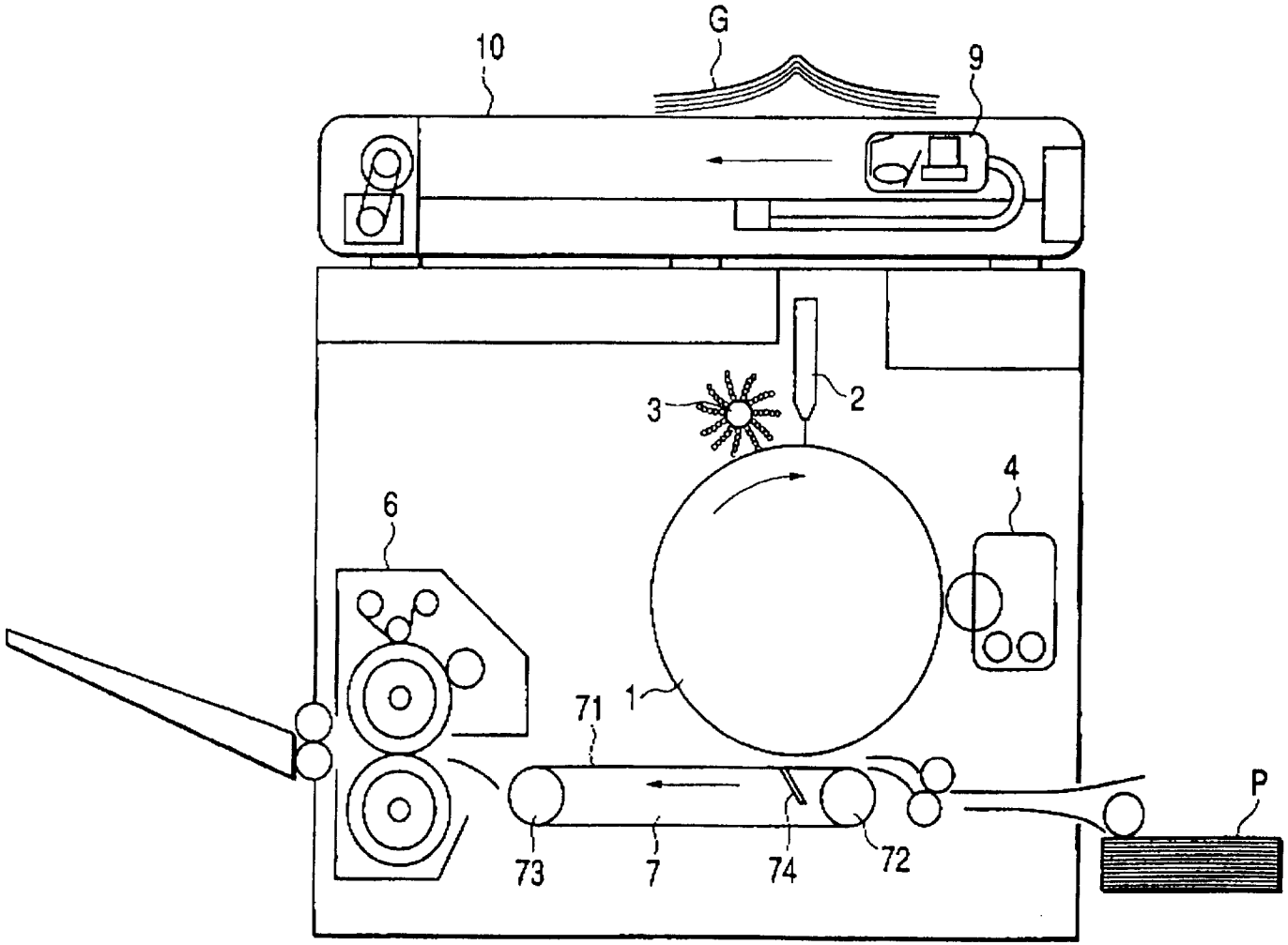
FIG. 23 is a schematic structural diagram of an image forming apparatus relating to an embodiment of the present invention.

Referring to FIG. 23, a printer portion of an image forming apparatus is structured in such a manner that a magnetic brush charging apparatus 3 that serves as a charging means, an exposing apparatus 2 that serves as an exposing means, a developing device 4 that serves as a developing means, a transfer device 7 that serves as a transfer means, and so on are disposed around a photosensitive drum 1 that serves as a body to be charged.

Figure 24:
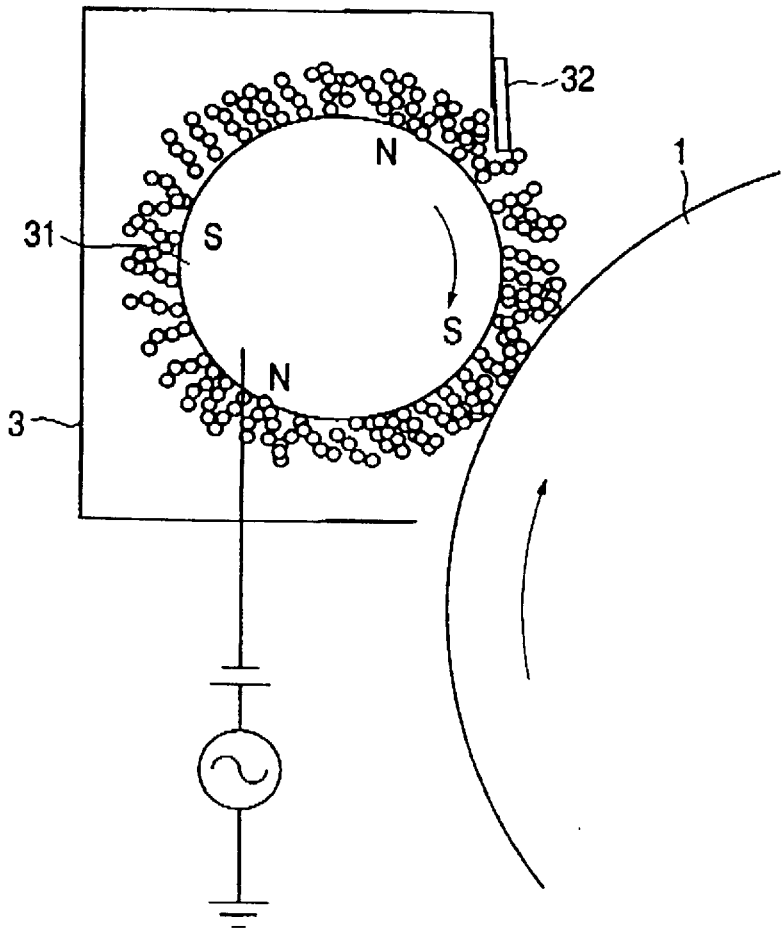
FIG. 24 is a schematic structural diagram of a charging means relating to an embodiment of the present invention.

FIG. 24 is a schematic structural diagram showing a charging means in accordance with an embodiment of the present invention.

Reference numeral 3 denotes a magnetic brush charger using magnetic carriers, and the charging magnetic carrier is preferably set to be 10 to 100 $\mu$m in average diameter, 20 to 250 emu/cm$^3$ (about 0.025 to 0.314 Wb/m$^2$) in saturation magnetization and $1\times10^2$ to $1\times10^{10}$ Ωcm (1 to $1\times10^8$ Ωcm) in resistance, and taking into consideration that insulating defects such as pin holes exist in the photosensitive drum 1, it is preferable to use the magnetic carrier $1\times10^6$ Ωcm ($1\times10^4$ Ωcm) or more in resistance. Since it is better to use the magnetic carrier with the resistance as small as possible in order to improve the charge performance, this embodiment uses the magnetic particles 25 $\mu$m in average diameter, 200 emu/cm$^3$ (about 0.251 Wb/m$^2$) in saturation magnetization and $5\times10^6$ Ωcm ($5\times10^4$ Ωcm) in resistance. Also, the charging magnetic carrier used in this embodiment is obtained by oxidizing and reducing a ferrite surface to adjust the resistance.

The photosensitive drum 1 according to this embodiment of the present invention may be formed of an organic photosensitive member (hereinafter referred to as "OPC photosensitive member"). Desirably, if an organic photosensitive member on which a surface layer made of a material $10^2$ to $10^{14}$ Ωcm ($1\times10^{12}$ Ωcm) in resistance is formed, or an amorphous silicon (hereinafter referred to as "a-Si") photosensitive member, etc., are used, charge implantation charging can be realized with the effects that the ozone is prevented from occurring and power consumption is reduced. Also, the charge property can be improved.

Figure 25:
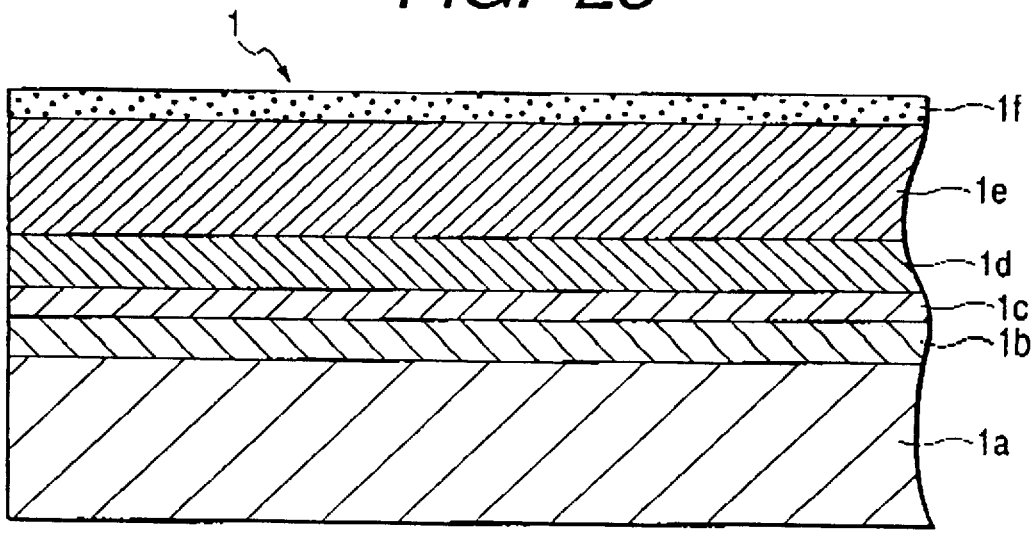
FIG. 25 is a schematic cross sectional diagram of a photosensitive drum relating to an embodiment of the present invention.

FIG. 25 is a schematic cross-sectional view showing a photosensitive drum in accordance with this embodiment of the present invention.

In the embodiment according to the present invention, there is used a photosensitive drum 1 which is formed of a negatively charged organic photosensitive member in which five layers consisting of the following first to fifth layers are formed on a drum body made of aluminum 30 mm in diameter in order from the last.

A first layer is an under layer 1*b* which is an electrically conductive layer 20 μm in thickness provided for eliminating the defects of the aluminum body 1*a*.

A second layer is a positive charge implantation preventing layer 1*c* which prevents the positive charges implanted from the aluminum body 1*a* from canceling the negative charge charged on the surface of the photosensitive member. The positive charge implantation preventing layer 1*c* is formed of a mid resistance layer 1 μm in thickness whose resistance is adjusted to about $1\times10^6$ Ωcm ($1\times10^4$ Ωcm) in resistance by amylan resin and methoxymethyl nylon.

A third layer is a charge generating layer 1*d* which is a layer about 0.3 μm in thickness where pigments are dispersed in a resin which generates a positive and negative charge pair by exposure.

A fourth layer is a charge transport layer 1*e* which is a p-type semiconductor where hydrozone is dispersed in a polycarbonate resin. Therefore, the negative charges charged on the surface of the photosensitive member cannot be moved through the layer, and only the positive charges generated by the charge generating layer 1*d* can be transported onto the surface of the photosensitive member.

A fifth layer is a charge implanting layer 1*f* which is a layer coated with a material where super fine particles of $SnO_2$ are dispersed in an insulating resin binder. Specifically, the charge implanting layer 1*f* is a coating layer of a material where $SnO_2$ particles are 0.03 μm in diameter whose resistance is lowered (electrical conductivity is rendered) by doping an insulating resin with antimony which is a light transmitting insulating filler are dispersed in the resin by 70 weight %. The coating solution thus mixed is coated with a thickness of about 3 μm through an appropriate coating method such as a dipping coating method, a spray coating method, a roll coating method or a beam coating method to form the charge implanting layer 16.

The first to fourth layers constitute a photosensitive layer, and the fifth layer constitutes the surface layer. The surface resistance is $10^{13}$ Ωcm ($10^{11}$ Ωcm). The surface resistance is thus controlled to directly improve the charging property, thereby being capable of obtaining a high-grade image. The photosensitive member is not limited to OPC but can be realized by an a-Si drum, thereby being capable of realizing a higher durability.

The volume resistance of the surface layer is a value measured by disposing metal electrodes at an interval of 200 μm, allowing a mixed fluid of the surface layer to flow between the metal electrodes to form a film and applying a voltage of 100 V between the electrodes. The measurement was made under the conditions where a temperature is 23° C. and a humidity is 50% RH.

Subsequently, the developing process will be described.

In general, the developing methods are roughly classified into four methods consisting of a method (one-component non-contact development) in which non-magnetic toner is coated on a sleeve by a blade or the like, and magnetic toner is coated and carried by a magnetic force so as to be developed in a non-contact state with respect to the photosensitive drum; a method (one-component contact development) in which the toner coated in the above-mentioned manner is developed in a contact state with respect to the photosensitive drum; a method (two-component contact phenomenon) in which the mixture of the toner particles with the magnetic carrier is used as a developer and carried by a magnetic force so as to be developed in a contact state with respect to the photosensitive drum (two-component contact development); and a method (two-component non-contact development) in which the above two-component developer is developed in a non-contact state. The two-component contact developing method is frequently employed from the viewpoints of the image high quality and the image high stability.

Figure 26:
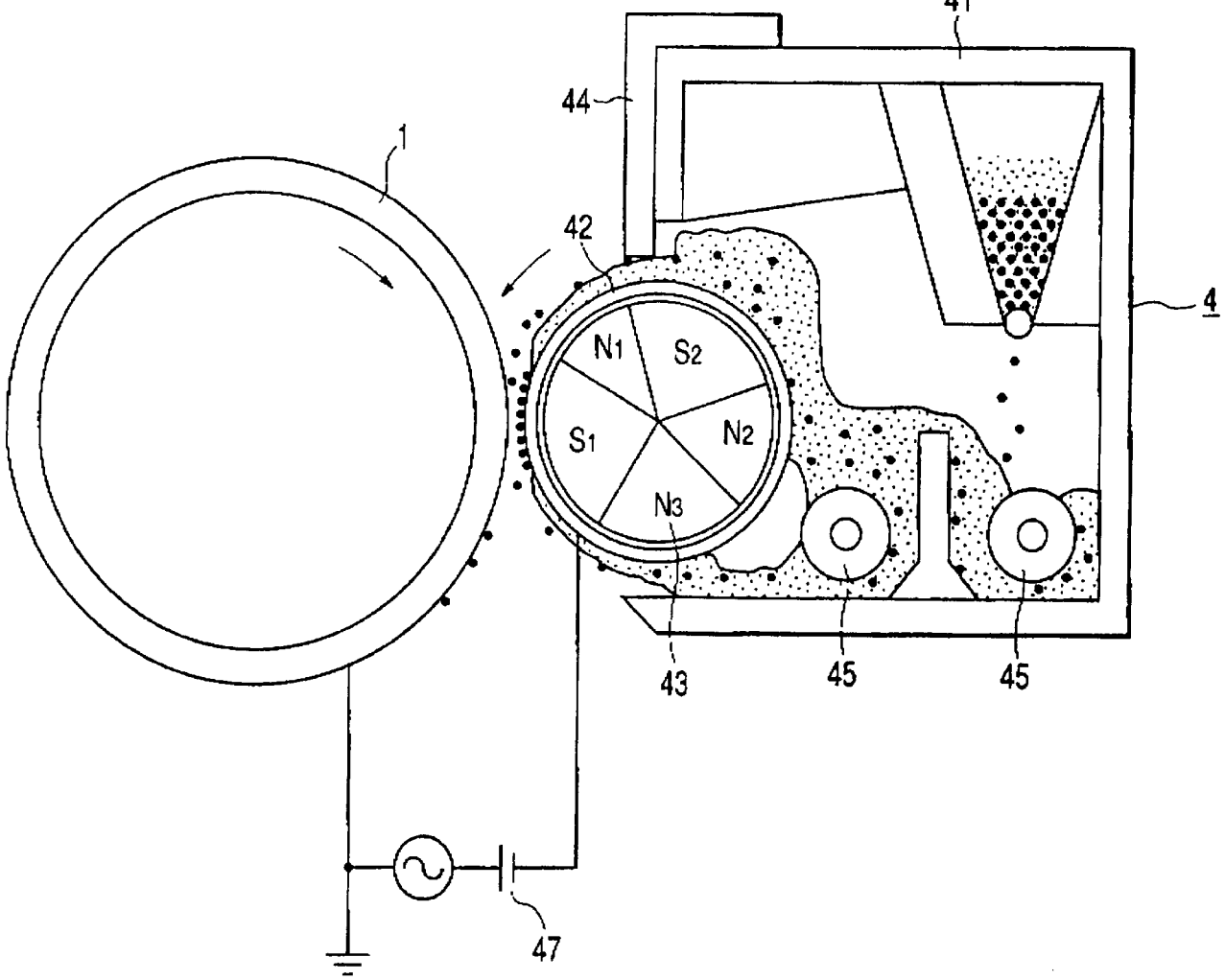
FIG. 26 is a schematic diagram of a two-component magnetic brush developer apparatus relating to an embodiment of the present invention.

FIG. 26 is a schematic structural diagram showing a developing device 4 for two-component magnetic brush development in accordance with an embodiment of the present invention.

In the figure, reference numeral 42 denotes a developing sleeve, reference numeral 43 is a magnetic roller fixed within the developing sleeve 42, reference numerals 45 denotes agitating screws, reference numeral 44 is a regulating blade disposed in order to form a thin film of the developer on the surface of the developing sleeve 42, and reference numeral 41 is a developing container. The developing sleeve 42 is disposed in such a manner that the closest contact region becomes about 500 μm with respect to the photosensitive drum 1 at least during the development, and set so that the developer can be developed in a state where the developer is in contact with the photosensitive drum 1.

The two-component developer used in this embodiment is a developer obtained by adding titanium oxide 20 nm in average diameter to negatively charged toner 6 μm in the average diameter of the toner particles by the weight ratio 1%, and the developing magnetic carrier as used is a magnetic carrier 35 μm in average diameter whose saturation magnetization is 205 emu/cm$^3$ (about 0.257 Wb/m$^2$). Also, the mixture of that toner with the developing magnetic carrier at the weight ratio of 6:94 is used as the developer. The toner in the developer is about $25\times10^{-3}$ C/kg in frictional charge amount.

A developing process of visualizing an electrostatic latent image formed on the photosensitive drum 1 through the two-component magnetic brush method by using the above developing device 4 and a developer circulating system will be described below.

First, the developer drawn up by an N2 pole with the rotation of the developing sleeve 42 is regulated by the regulating blade 44 disposed perpendicular to the developing sleeve 42 during a process where the developer is carried from the S2 pole to an N1 pole, to thereby form a thin film on the developing sleeve 42. When the developer formed in the thin film is carried to the developing main pole, that is, the S1 pole, the spikes are formed by a magnetic force. The electrostatic latent image is developed by the developer formed into standing spikes, and thereafter the developer on the developing sleeve 42 is returned to the interior of the developing container 41 by the repulsion magnetic field of the N3 pole and the N2 pole.

A direct current voltage and an alternating current voltage are applied to the developing sleeve 42 from a power supply 47, and in this embodiment, the direct current voltage of −480 V, the alternating current voltage Vpp=1500 V and Vf=3000 Hz are applied to the developing sleeve 41. In general, when the alternating current voltage is applied in the two-component developing method the developing efficiency increases, and an image becomes high in grade, but there occurs such a problem that fog is liable to occur. For that reason, usually realization of fog prevention by provision of an electric potential difference between the direct current voltage applied to the developing device 4 and the surface electric potential of the photosensitive drum 1. The electric potential difference for preventing the fog is called "fog removing bias (Back)", and the electric potential difference prevents the toner from being stuck onto a non-image region during the development.

The toner image is then transferred onto a recording material P by the transfer device 7. The transfer device 7 is rotated in a direction indicated by an arrow in FIG. 23 due to an endless belt 71 put between a driver roller 72 and a driven roller 73. Further, a transfer charge blade 74 is disposed within the transfer device 7, and the transfer charge blade 74 generates a pressure from the inside of the belt 71 in a direction of the photosensitive drum 1 and has a power supplied from a high voltage power supply not shown, to thereby conduct charging with the polarity inverse to that of the toner from the rear side of the recording material P, with the result that the toner image on the photosensitive drum 1 is successively transferred onto the upper surface of the recording material P.

The recording material P is conveyed from the paper conveying device to a transfer portion formed by the photosensitive drum 1 and a belt 71 at an appropriate timing in synchronism with the rotation of the photosensitive drum 1.

Also, in this embodiment, the belt 71 is made of polyimide resin 75 $\mu$m in thickness. The material of the belt 71 is not limited to polyimide resin, but plastic such as polycarbonate resin, polyethylene terephthalate resin, polyfluoride vinylidine resin, polyethylene naphthalate resin, polyether ether ketone resin, polyether sulphone resin, and polyurethane resin; a fluoride; and a silicon rubber can be properly employed. Also, the thickness is not limited to 75 $\mu$m, but the thickness of 25 to 2000 $\mu$m, preferably 50 to 150 $\mu$m can be properly applied.

In addition, the transfer charging blade 74 as used in $1\times10^5$ to $1\times10^7$ Ω in resistance. A bias of +15 $\mu$A is applied to the transfer charging blade 74 under the constant current control to conduct the transfer operation.

In the above manner, the toner image formed on the photosensitive drum 1 is electrostatically transferred onto the recording material P by the transfer charging blade 74. Thereafter, the recording material is conveyed to the fixing device 6 and thermally fixed to output an image.

On the other hand, a remaining transfer toner remains on the photosensitive drum 1 which has been subjected to the above transfer process. There are many cases in which the positive and negative remaining transfer toner is mixed on the photosensitive drum 1 due to the separation discharge during the transferring operation. The remaining transfer toner where the positive and negative toner is mixed together is carried to the magnetic brush charging apparatus 3 and mixed with the magnetic particles within the magnetic brush charging apparatus 3, and all the toner is negatively charged and then expelled on the photosensitive drum 1.

In this situation, it is not sufficient to take the toner in the magnetic brush charging apparatus 3 by only applying a direct current voltage to the magnetic brush charging apparatus 3, but if an alternating voltage is applied to the magnetic brush charging apparatus 3, it becomes easy to take the toner in the magnetic brush charging apparatus 3 due to the vibrating effect caused by an electric field between the photosensitive drum 1 and the magnetic brush charging apparatus 3.

The remaining transfer toner whose polarity is uniformed by the magnetic brush charging apparatus 3, and which is expelled onto the photosensitive drum 1 is collected within the developing device 4 due to the fog removing bias during the developing operation.

The development and the collection conducted at the same time are conducted simultaneously with other image forming processes such as charging, exposure, development and transfer if the image region in the rotating direction is longer than the peripheral length of the photosensitive drum 1. As a result, because the remaining transfer toner is collected and used in a succeeding process, the waste toner can be eliminated. Also, the advantage from the spatial viewpoint is large, and the apparatus can be significantly downsized.

Figure 27:
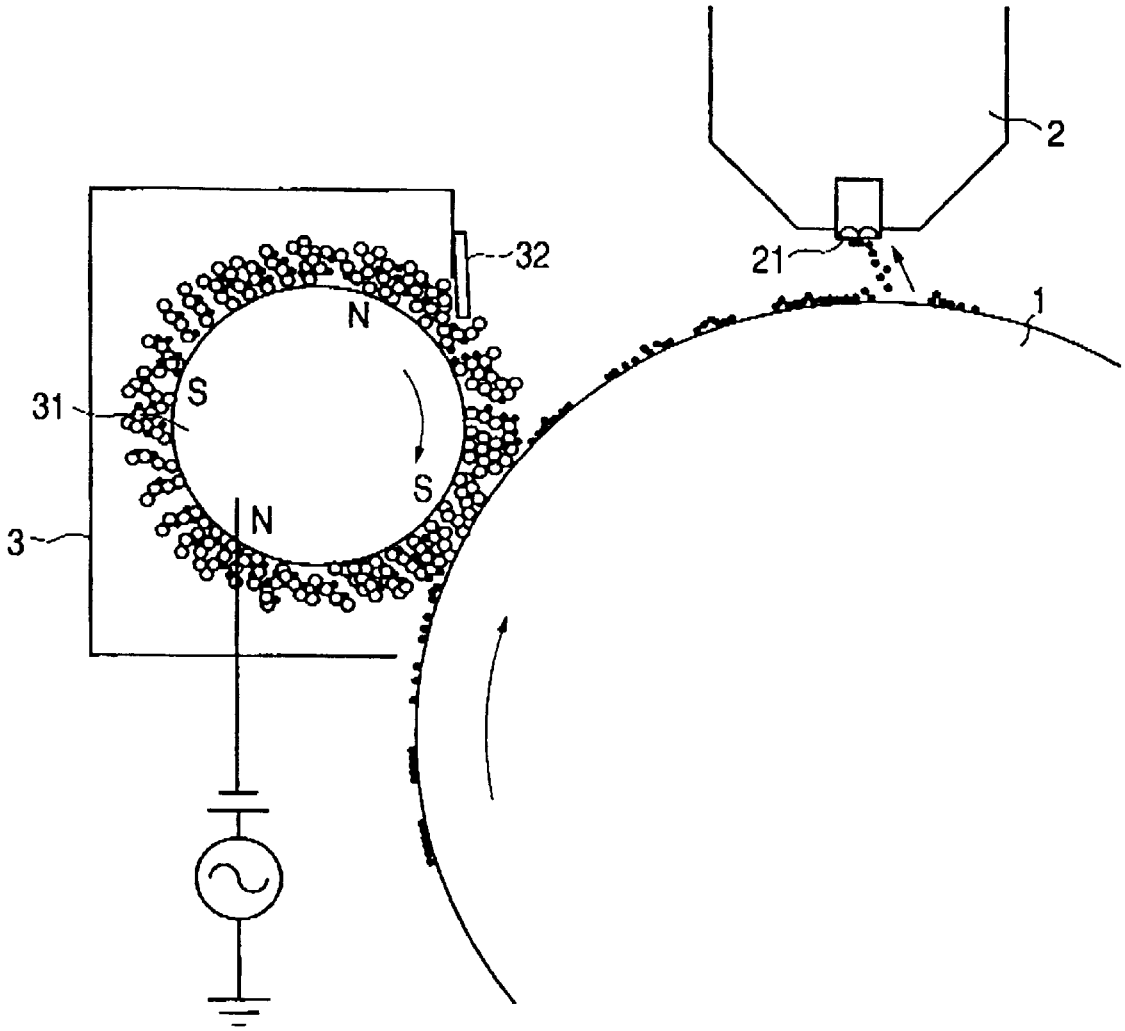
FIG. 27 is a schematic structural diagram for explaining an exposure scattering phenomenon.

However, as shown in FIG. 27, in the cleanerless image forming apparatus that conducts developing and cleaning simultaneously by using the above magnetic brush charging apparatus 3, there occurs such a phenomenon (hereinafter referred to as "exposure scattering phenomenon") that the remaining transfer toner which has been expelled on the photoelectric drum 1 after being collected by the magnetic brush charging apparatus 3 flies and is adhered onto an exposure light irradiating portion 21 due to an electric field attracted from the drum surface in the direction of the exposure light irradiating portion 21 with a change in the surface electric potential of the photosensitive drum 1 when exposure is conducted by the exposing apparatus 2 in a succeeding process. It is presumed that the exposure scattering phenomenon occurs by changing the surface electric potential distribution of the photosensitive drum 1 upon receiving the exposure.

Under the above circumstances, the present inventors conducted an experiment where the toner of 4% is forcedly mixed within the magnetic brush charging apparatus 3 with the structure used in this embodiment, and the toner is forcedly expelled while conducting uniform exposure over the entire surface. In this experiment, the developer is not inserted in the developing device 4, and the drive of the photosensitive drum 1 and the bias application are not conducted at all. Then, the surface electric potential (hereinafter referred to as "Vd") of the photosensitive drum 1 after being changed is held constant to −800 V, and the surface electric potential (hereinafter referred to as "V1") of the photosensitive drum 1 after being exposed is changed, to thereby change the latent image contrast which is a difference between Vd and V1, to conduct the experiment.

As a result of the experiment, it was proved that the toner expelled onto the photosensitive drum 1 flies perpendicular to the direction of the exposure light irradiating portion 21 as smaller the latent image contrast is. As a result, in the case where the latent image contrast is small under the actually used conditions, that is, in the case where halftone exposure is conducted, the exposure scattering phenomenon remarkably occurs.

In the case where the exposure scattering phenomenon occurs, because the exposure light irradiating portion 21 is shielded from the light by the toner adhered thereon, an appropriate exposure amount cannot be given to the photosensitive drum 1 at a portion of the exposure light irradiating portion 21 to which the toner is adhered, and the image defect where the image lacks occurs.

Figure 28:
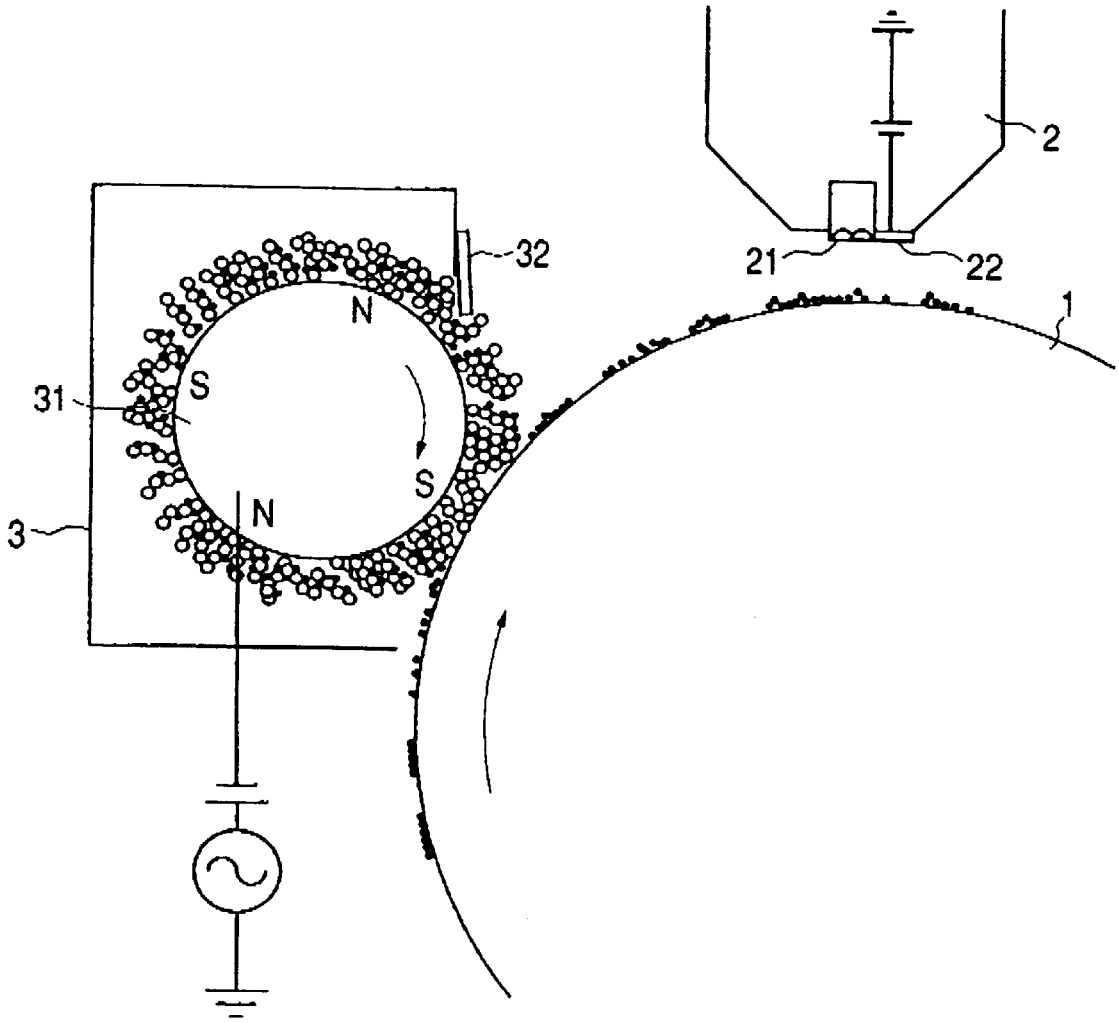
FIG. 28 is a schematic structural diagram of a conductive member relating to a seventh embodiment of the present invention.

In order to prevent the above-described exposure scattering phenomenon, in this embodiment, as shown in FIG. 28, an conductive member 22 is disposed downstream of the rotating direction of the photosensitive drum 1 so as to be adjacent to the exposure light irradiating portion 21 of the exposing apparatus 2, and a bias is applied to the conductive member 22. The longitudinal direction of the conductive member 22 is made in parallel with the exposure light irradiating portion 21.

Figure 29A:
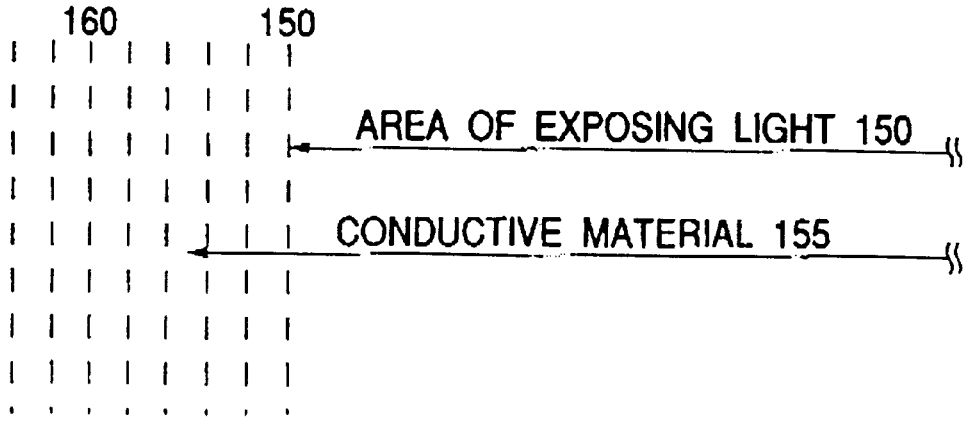
FIGS. 29A and 29B are diagrams for explaining end portion positioning in a longitudinal direction of a conductive member relating to an embodiment of the present invention.
Figure 29B:
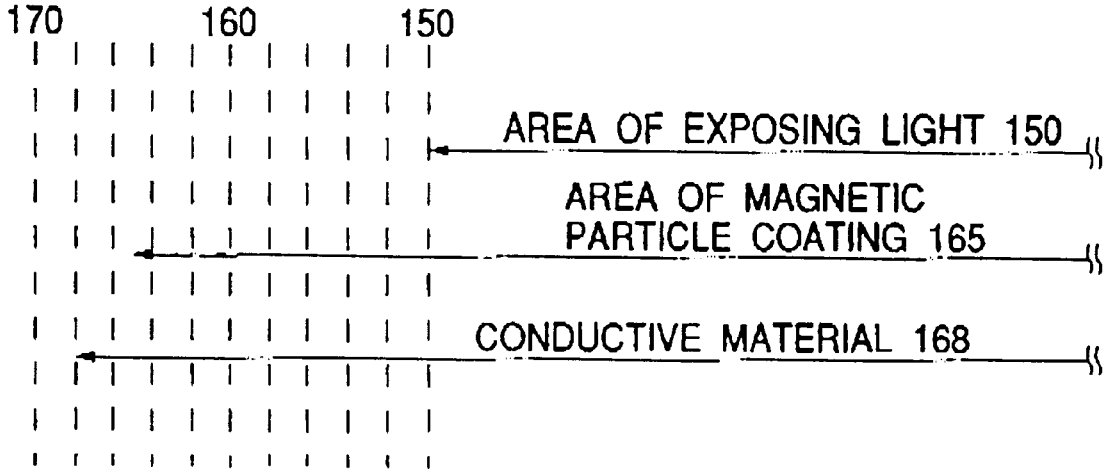

FIGS. 29A and 29B are explanatory diagrams showing a longitudinal end portion position of an electrically conductive member in accordance with an embodiment of the present invention, in which FIG. 29A is a diagram showing the positional relationship between the conductive member 22 and the exposure light irradiating region, and FIG. 29B is a diagram showing the positional relationship of the conductive member 22, the exposure light irradiating region and the magnetic particle coated region.

In the figures, numeral values represent the relative distance (mm in unit) from the center of an image (the center of the image forming region on the photosensitive drum 1). It is needless to say that the numerals in the figures show one example of this embodiment and any modifications are not out of the scope of the present invention as long as the relative positional relationship of the conductive member 22 end portion, the exposure light irradiating region and the magnetic particle coated region is maintained.

It is proved that the exposure scattering phenomenon occurs when the remaining toner expelled from the magnetic brush charging apparatus 3 exists on the photosensitive drum 1, and that region is exposed by the exposing apparatus 2 in a succeeding process as described above. From this fact, as shown in FIG. 29A, it is necessary that the end portion of the conductive member 22 disposed adjacent and in parallel to the exposure light irradiating portion 21 of the exposing apparatus 2 is disposed outside of the end portion of the exposure light irradiating region of the exposure light irradiating portion 21.

In addition, since where the remaining transfer toner is expelled onto the photosensitive drum 1 from the magnetic brush charging apparatus 3 is a magnetic particle coated region which is a charged region, as shown in FIG. 29B, it is more desirable that the end portion of the conductive member 22 disposed adjacent to the exposure light irradiating portion 21 of the exposing apparatus 2 in parallel is disposed outside of the end portion of the exposure light irradiating region of the exposure light irradiating portion 21 and outside of the magnetic particle coated region of the magnetic brush charging apparatus 3.

With the above structure, the electric field directed from the surface of the photosensitive drum 1 toward the exposure light irradiating portion 21 is weakened, and an electric field in a direction of pushing the toner expelled on the photosensitive drum 1 toward the photosensitive drum 1 is exerted, thereby being capable of preventing the exposure scattering phenomenon from occurring.

According to the experiment by the present inventors, a bias applied to the conductive member 22 disposed adjacent and in parallel to the exposure light irradiating portion 21 of the exposure apparatus 2 is set to be identical in polarity with the Vd charged by the magnetic brush charging apparatus 3 and to be larger in absolute value than the Vd, thereby being capable of perfectly preventing the exposure scattering phenomenon.

According to this embodiment, such a problem that the remaining transfer toner expelled from the magnetic brush charging apparatus 3 flew from the surface of the photosensitive member due to the fluctuation of the surface electric potential distribution of the photosensitive drum 1 by the image exposure and then adhered onto the exposing apparatus 2 to cause the image defect is improved, thereby being capable of providing a stable image over the long period of time.

<Embodiment 8>

Figure 30:
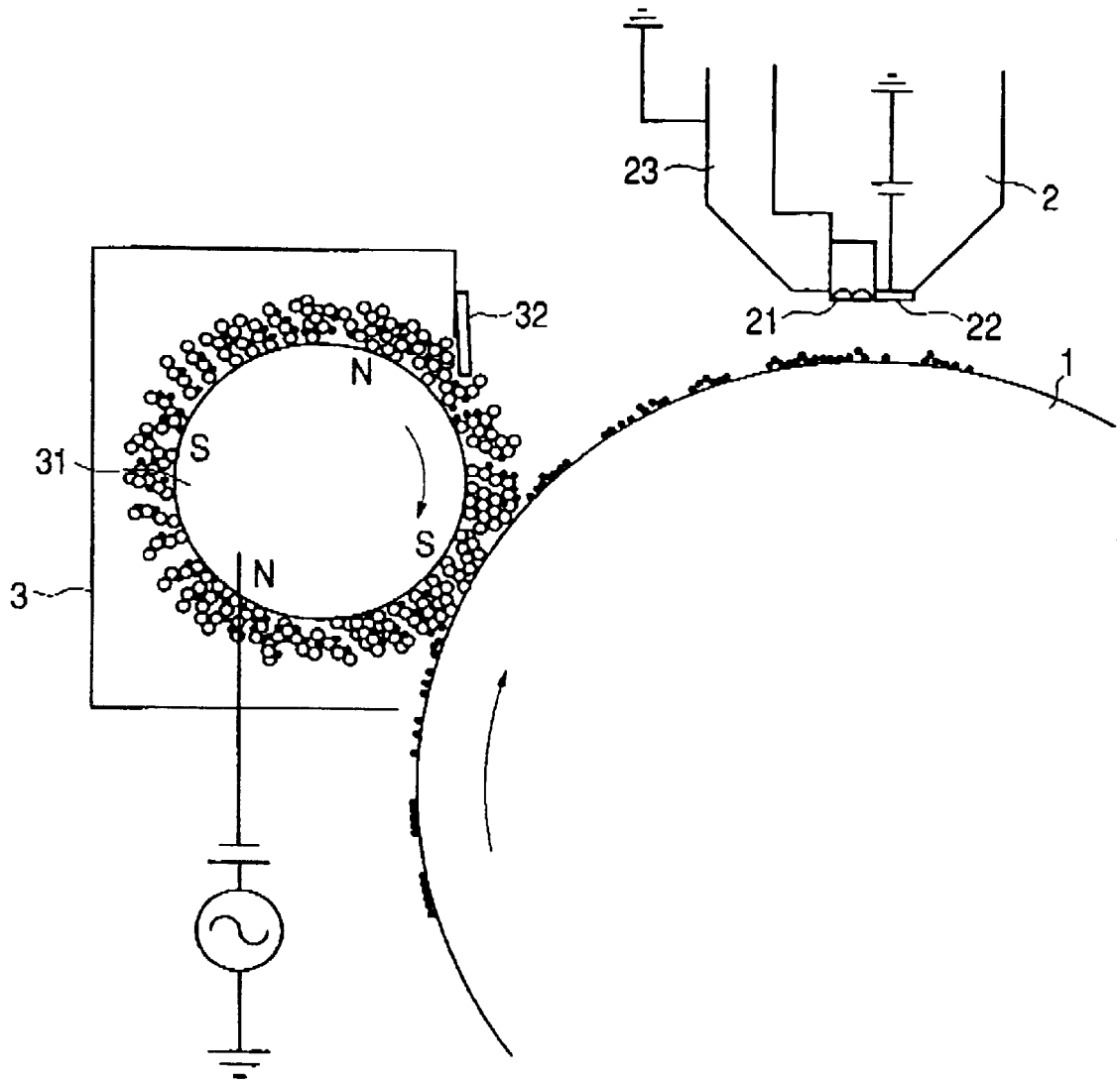
FIG. 30 is a schematic structural diagram of a conductive member relating to an eighth embodiment of the present invention.

FIG. 30 shows an eighth embodiment. This embodiment shows a structure in which a conductive member 23 is also so disposed as to be adjacent to the exposure light irradiating portion 21 of the exposing apparatus 2 shown in the above-mentioned first embodiment, upstream of the rotating direction of the photosensitive drum 1.

Since other structures and operation are identical with those in the seventh embodiment, the same structural parts are designated by like references and their description will be omitted.

As shown in FIG. 30, in the case where the electrically conductive member 23 is grounded, the electric field in the direction of pushing the expelled toner on the photosensitive drum 1 toward the photosensitive drum 1 is further strengthened, and the exposure scattering phenomenon can be further prevented from occurring.

<Embodiment 9>

Figure 31:
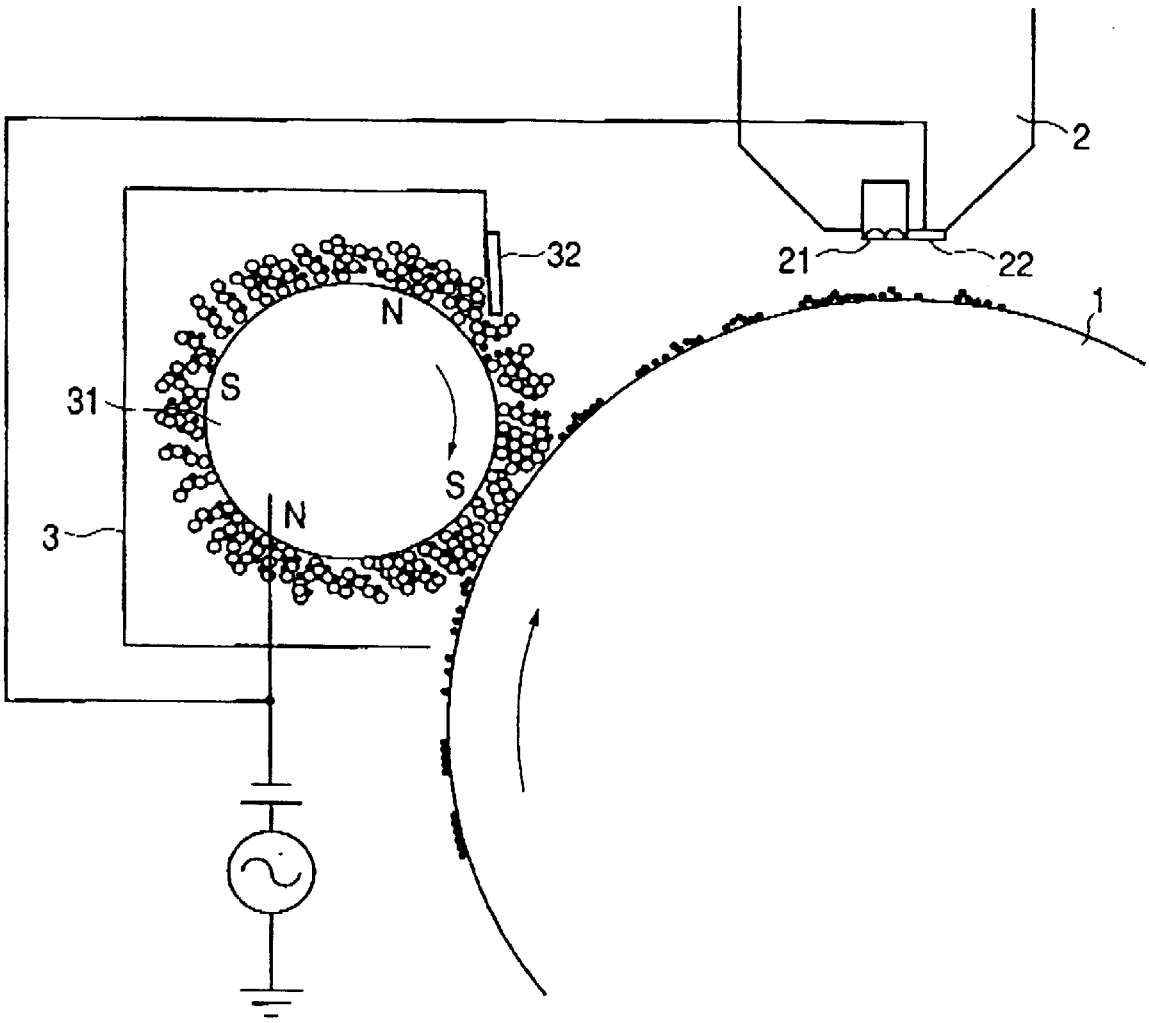
FIG. 31 is a schematic structural diagram of a conductive member relating to a ninth embodiment of the present invention.

FIG. 31 shows a ninth embodiment. In this embodiment, as the supply bias to the conductive member 22 shown in the above-mentioned seventh embodiment, a bias which is applied to the magnetic brush charging apparatus 3 is employed.

Since other structures and operation are identical with those in the seventh embodiment, the same structural parts are designated by like references and their description will be omitted.

As shown in FIG. 31, since the bias applied to the magnetic brush charging apparatus 3 can be used as the supply bias to the conductive member 22 disposed adjacent and in parallel to the exposure light irradiating portion 21, there is an advantage in that the prevention of the exposure scattering phenomenon can be achieved without increasing an additional power supply device to the conventional device. The bias applied to the conductive member 22 disposed adjacent and in parallel to the exposure light irradiating portion 21 of the exposing apparatus 2 is applied to the magnetic brush charging apparatus 3. The bias where an alternating voltage is superimposed on the direct current voltage may be applied, or even if only a direct current component is applied, the effect on the exposure scattering phenomenon can be exhibited likewise.

<Embodiment 10>

Figure 32:
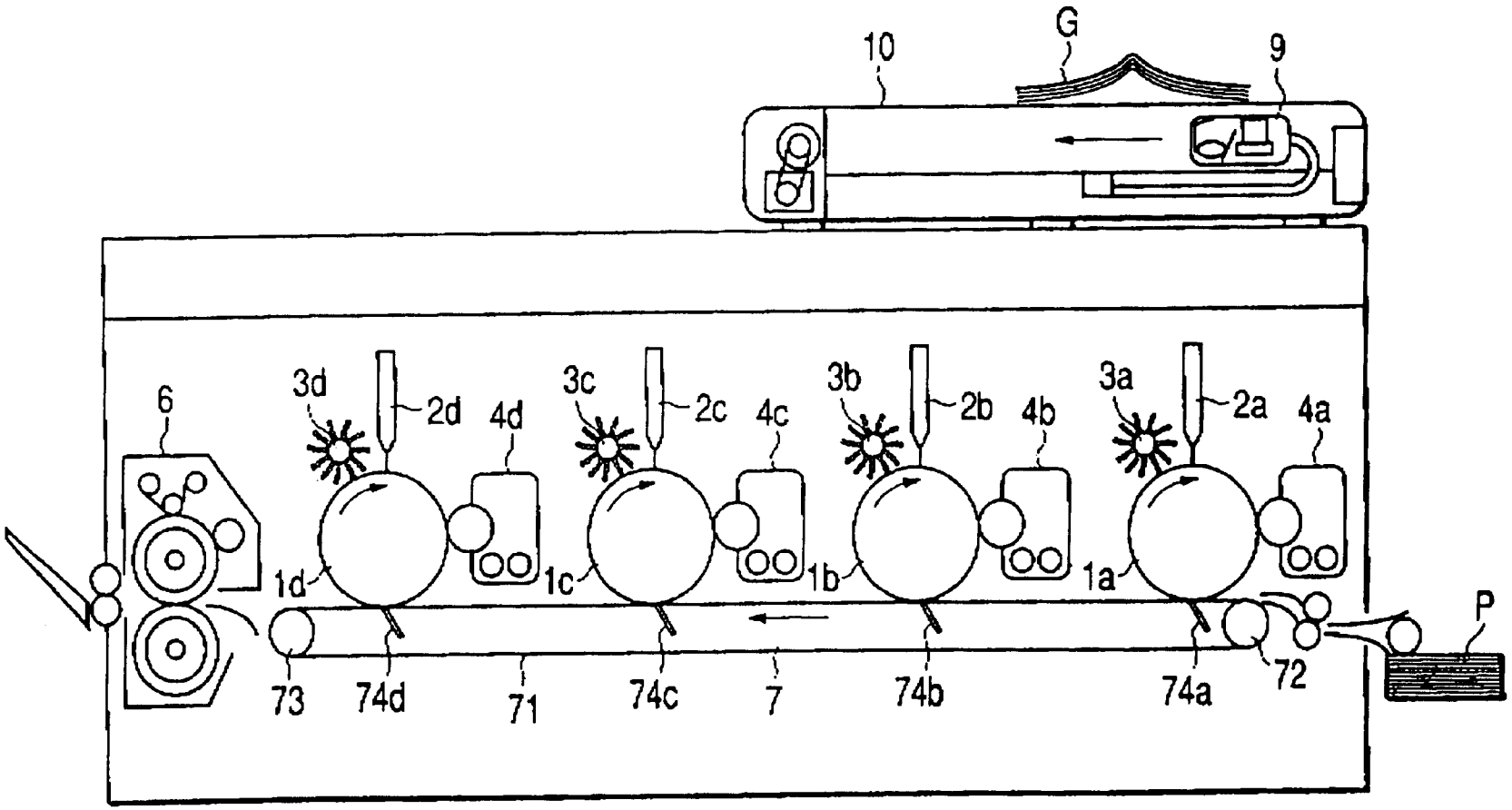
FIG. 32 is a schematic structural diagram of an image forming apparatus relating to a tenth embodiment of the present invention.

FIG. 32 shows a tenth embodiment.

FIG. 32 is a schematic structural diagram showing an image forming apparatus of the tandem system in accordance with an embodiment of the present invention. In FIG. 32, in a printer portion of the image forming apparatus, four of the first to fourth stations are disposed in parallel, and images of four colors are successively superimposed and transferred on a recording material through one path which is one conveyance of the recording material P, thereby being capable of conducting color recording at a high speed.

The first station is made up of a photosensitive drum 1*a*, and an exposing apparatus 2*a*, a magnetic brush charging apparatus 3*a*, a developing device 4*a*, a transfer charging blade 74*a*, etc., which are disposed around the photosensitive drum 1*a*. Likewise, the second, third and fourth stations are made up of photosensitive drums 1*b*, 1*c* and 1*d*, and exposing apparatuses 2*b*, 2*c* and 2*d*, magnetic brush chargers 3*b*, 3*c* and 3*d*, developing devices 4*b*, 4*c* and 4*d*, transfer charging blade 74*b*, 74*c* and 74*d*, etc., which are disposed around the photosensitive drum 1*b*, 1*c* and 1*d*.

Since other structures and operation are identical with those in the seventh embodiment, the same structural parts are designated by like references and their description will be omitted.

Since the electrically conductive member described in the above embodiments is disposed on each of the exposing apparatus 2*a* to 2*d*, even if the toner in a previous station is mixed with the expelled toner from each of the magnetic brush chargers 3*a* to 3*d*, the exposure scattering phenomenon can be prevented from occurring, thereby being capable of obtaining an excellent color image.

The present invention is not limited to the above-described embodiments, but includes variations or modifications within the technical concept of the present invention.

What is claimed is:

1. An image forming apparatus comprising:

a photosensitive member for bearing a toner image;

charging means for charging the photosensitive member and bringing back the residual toner charged in a same polarity as a polarity of the charging means;

image exposing means for exposing the photosensitive member in accordance with an image information, said image exposing means having a light irradiating portion facing the photosensitive member;

a conductive member disposed adjacent to the light irradiating portion; and voltage application means for applying a voltage to the conductive member, wherein the voltage applied by the voltage application means forms an electric field between the photosensitive member and the conductive member to push said toner brought back to the photosensitive member to move in a direction of the photosensitive member.

2. An image forming apparatus according to claim 1, wherein said light irradiating portion comprises a plurality of light emitting elements for emitting light in accordance with the image information.

3. An image forming apparatus according to claim 1, wherein the voltage is equal to or greater than 1500 V.

4. An image forming apparatus according to claim 3, wherein an electric power supply of said voltage application means is combined with an electric power supply of said charging means.

5. An image forming apparatus according to claim 1, wherein said conductive member is disposed downstream of said image exposing means in a direction of rotation of said photosensitive member.

6. An image forming apparatus according to claim 5, further comprising a second conductive member disposed upstream of said image exposing means in a direction of rotation of said photosensitive member.

7. An image forming apparatus comprising:

a photosensitive member for bearing a toner image;

charging means for charging the photosensitive member, collecting residual toner on the photosensitive member and bringing back the residual toner charged in a same polarity as a charged polarity of the charging means;

image exposing means for exposing the photosensitive member in accordance with an image information, said image exposing means having a light irradiating portion facing the photosensitive member;

a conductive member disposed adjoining the light irradiating portion; and voltage application means for applying a voltage to the conductive member, the voltage having a same polarity as the charged polarity, wherein the voltage application means applies the voltage during the time the conductive member faces the charged photosensitive member.

8. An image forming apparatus according to claim 7, wherein said light irradiating portion comprises a plurality of light emitting elements for emitting light in accordance with the image information.

9. An image forming apparatus according to claim 7, wherein said conductive member is disposed downstream of said exposing means in a direction of rotation of said photosensitive member.

10. An image forming apparatus according to claim 9, further comprising a second conductive member disposed upstream of said exposing means in a direction of rotation of said photosensitive member.

11. An image forming apparatus according to claim 7, wherein an electric power supply of said voltage application means is combined with an electric power supply of said charging means.

12. An image forming apparatus comprising:

a photosensitive member;

image exposing means for exposing said photosensitive member in accordance with an image information, said image exposing means having a light irradiation portion facing said photosensitive member;

a conductive member adjoining said light irradiation portion; and voltage application means for applying a voltage to said conductive member, wherein said voltage application means applies a voltage to said conductive member in synchronism with a timing for driving said photosensitive member.

13. An image forming apparatus according to claim 12, wherein said light irradiation portion comprises a plurality of light emitting elements for emitting light in accordance with the image information.

14. An image forming apparatus according to claim 12, further comprising charging means for charging said photosensitive member.

15. An image forming apparatus according to claim 14, wherein an electric power supply of said voltage application means is combined with an electric power supply of said charging means.

16. An image forming apparatus according to claim 12, wherein said conductive member is disposed downstream of said exposing means in a direction of rotation of said photosensitive member.

17. An image forming apparatus according to claim 16, further comprising a second conductive member disposed upstream of said exposing means in a direction of rotation of said photosensitive member.

18. An image forming apparatus comprising:

a photosensitive member;

image exposing means for exposing the photosensitive member in accordance with an image information, said image exposing means having a light irradiating portion facing the photosensitive member;

a conductive member adjoining the light irradiating portion;

environment detection means for detecting a temperature and a humidity within said apparatus; and voltage application means for applying a voltage to the conductive member, wherein the voltage application means applies a voltage to the conductive member in correspondence with output of the environmental detection means.

19. An image forming apparatus according to claim 18, wherein said light irradiating portion comprises a plurality of light emitting elements for emitting light in accordance with the image information.

20. An image forming apparatus according to claim 18, further comprising charging means for charging said photosensitive member.

21. An image forming apparatus according to claim 18, wherein said conductive member is disposed downstream of said image exposing means in a direction of rotation of said photosensitive member.

22. An image forming apparatus according to claim 21, further comprising a second conductive member disposed upstream of said exposing means in a direction of rotation of said photosensitive member.

23. An image forming apparatus comprising:

a photosensitive member;

charging means for charging said photosensitive member;

image exposing means for exposing said photosensitive member in accordance with image information, said image exposing means having a light irradiation portion facing said photosensitive member;

a conductive member adjoining said light irradiation portion, said conductive member having two end portions, wherein both of said two end portions of said conductive member along a longitudinal direction of said photosensitive member are disposed outside of a charging region of said photosensitive member.

24. An image forming apparatus according to claim 23, wherein said light irradiation portion comprises a plurality of light emitting elements for emitting light in accordance with the image information.

25. An image forming apparatus according to claim 23, wherein said conductive member is disposed downstream of said exposing means in a direction of rotation of said photosensitive member.

26. An image forming apparatus according to claim 25, further comprising a second conductive member disposed upstream of said exposing means in a direction of rotation of said photosensitive member.

27. An image forming apparatus according to claim 23, further comprising voltage application means for applying a voltage to said conductive member, and wherein an electric power supply of said voltage application means is combined with an electric power supply of said charging means.

* * * * *

UNITED STATES PATENT AND TRADEMARK OFFICE

CERTIFICATE OF CORRECTION

PATENT NO. : 6,477,342 B2
DATED : November 5, 2002
INVENTOR(S) : Yoshiyuki Komiya et al.

It is certified that error appears in the above-identified patent and that said Letters Patent is hereby corrected as shown below:

Column 1,
Line 26, “a” (first occurrence) should read -- an --; and
Line 35, “in” (first occurrence) should be deleted.

Column 3,
Line 33, “synchronous” should read -- synchronous with --; and
Lines 63 and 66, “cross sectional” should read -- cross-sectional --.

Column 4,
Lines 1, 13 and 56, “cross sectional” should read -- cross-sectional --.

Column 5,
Line 26, “structural” should read -- structure --; and
Line 27, “to” should read -- of --.

Column 7,
Line 55, “which” should read -- within --.

Column 8,
Line 23, “form” should read -- from --.

Column 13,
Line 14, “time” should read -- time. --.

Column 14,
Line 66, “$S_x$” should read -- $S_k$ --.

Column 16,
Line 31, “can” should read -- can be --; and
Line 36, “if” (second occurrence) should read -- of --.

Column 17,
Line 52, “cross sectional” should read -- cross-sectional --.

Column 18,
Line 5, “carrying” should read -- charging --.

Column 24,
Line 14, “suitable” should read -- suitably --.

UNITED STATES PATENT AND TRADEMARK OFFICE

CERTIFICATE OF CORRECTION

PATENT NO. : 6,477,342 B2
DATED : November 5, 2002
INVENTOR(S) : Yoshiyuki Komiya et al.

It is certified that error appears in the above-identified patent and that said Letters Patent is hereby corrected as shown below:

Column 27,
Line 46, "in" should read -- is --.

Column 28,
Line 58, "as smaller the latest image contrast is" should read -- as the latent image becomes smaller --.

Signed and Sealed this

Twenty-sixth Day of August, 2003

JAMES E. ROGAN
*Director of the United States Patent and Trademark Office*